US009308730B2

(12) United States Patent
Maida et al.

(10) Patent No.: US 9,308,730 B2
(45) Date of Patent: Apr. 12, 2016

(54) NOZZLE FACE WIPING DEVICE AND IMAGE RECORDING DEVICE

(71) Applicant: FUJIFILM Corporation, Tokyo (JP)

(72) Inventors: Noriaki Maida, Ashigarakami-gun (JP); Yuichi Ozaki, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/611,705

(22) Filed: Feb. 2, 2015

(65) Prior Publication Data

US 2015/0146120 A1 May 28, 2015

Related U.S. Application Data

(63) Continuation of application No. PCT/JP2013/070569, filed on Jul. 30, 2013.

(30) Foreign Application Priority Data

Aug. 13, 2012 (JP) ..... 2012-179273
Jul. 16, 2013 (JP) ..... 2013-147448

(51) Int. Cl.
*B41J 2/165* (2006.01)

(52) U.S. Cl.
CPC ..... *B41J 2/16544* (2013.01); *B41J 2/16535* (2013.01); *B41J 2/16552* (2013.01); *B41J 2/16588* (2013.01); *B41J 2002/1655* (2013.01); *B41J 2002/16591* (2013.01)

(58) Field of Classification Search
CPC .... B41J 2/16535; B41J 2/165; B41J 2/16505; B41J 2/16526; B41J 2/1707; B41J 2/1714; B41J 2002/1655
USPC ..... 347/33
See application file for complete search history.

(56) References Cited

U.S. PATENT DOCUMENTS 4,369,456 A * 1/1983 Cruz-Uribe et al. ..... 347/33
6,170,946 B1 * 1/2001 Yasui et al. ..... 347/108

(Continued)

FOREIGN PATENT DOCUMENTS

JP 2006-112515 A 4/2006
JP 2008-055754 A 3/2008

(Continued)

OTHER PUBLICATIONS

Notification of Transmittal of Translation of the International Preliminary Report on Patentability and Translation of Written Opinion of the International Searching Authority; PCT/JP2013/070569; issued on Feb. 26, 2015.

(Continued)

*Primary Examiner* — Stephen Meier
*Assistant Examiner* — Sharon A Polk
(74) *Attorney, Agent, or Firm* — Studebaker & Brackett PC

(57) ABSTRACT

The present invention provides a nozzle face wiping device and an image recording device that can switch whether to wipe out a nozzle face by a simple mechanism. According to one mode of the present invention, it is possible to brake the running of the wiping web by the braking device on the upstream side (supply shaft side) of the pressure member. In a case where the running direction of the wiping web wound around the pressure member and the relative movement direction of the nozzle face are the same, it is possible to prevent the wiping web from being forcefully drawn out from the supply shaft by braking the running of the wiping web by the braking device. By this means, it is possible to wipe out the nozzle face from two directions.

10 Claims, 16 Drawing Sheets

(56) References Cited

U.S. PATENT DOCUMENTS

| | | | | |
|---|---|---|---|---|
| 2010/0238234 | A1 | 9/2010 | Inoue | |
| 2010/0245466 | A1 | 9/2010 | Inoue | |
| 2012/0194610 | A1 * | 8/2012 | Kyoso | 347/33 |

FOREIGN PATENT DOCUMENTS

| | | | | |
|---|---|---|---|---|
| JP | 2008055754 | A | * | 3/2008 |
| JP | 2009-051630 | A | | 3/2009 |
| JP | 2010-234666 | A | | 10/2010 |
| JP | 2010-234667 | A | | 10/2010 |
| JP | 2010-240507 | A | | 10/2010 |
| JP | 2010-241127 | A | | 10/2010 |
| JP | 2010234666 | A | * | 10/2010 |
| JP | 2011-073145 | A | | 4/2011 |
| JP | 2011-083900 | A | | 4/2011 |

OTHER PUBLICATIONS

International Search Report; PCT/JP2013/070569; Aug. 27, 2013.

Japanese Office Action, Notification of Reasons for Rejection (Partial Translation) issued on Jul. 1, 2015 in Japanese Patent Application No. 2013-147448.

* cited by examiner

NOZZLE FACE WIPING DEVICE AND IMAGE RECORDING DEVICE

CROSS-REFERENCE TO RELATED APPLICATIONS

This application is a Continuation of PCT International Application No. PCT/JP2013/070569 filed on Jul. 30, 2013, which claims priority under 35 U.S.C. §119(a) to Japanese Patent Application Nos. 2012-179273 filed on Aug. 13, 2012 and 2013-147448 filed on Jul. 16, 2013. Each of the above application(s) is hereby expressly incorporated by reference, in its entirety, into the present application.

BACKGROUND OF THE INVENTION

1. Field of the Invention

The present invention relates to a nozzle face wiping device and an image recording device, and particularly relates to a nozzle face wiping device and an image recording device that wipe out the nozzle face of an ejection head by the use of a wiping web.

2. Description of the Related Art

When an inkjet head (ejection head) mounted to an inkjet printing device (image recording device) is used, a foreign body such as the residue of ink and paper dust adheres to a nozzle face. The adhesion of the foreign body to the nozzle face causes an ejection defect such as non-ejection and an ejection direction defect. Therefore, in the inkjet printing device, the cleaning of the nozzle face is regularly performed. As one cleaning method of this nozzle face, there is known a method of wiping out the nozzle face by a flat wiping member having absorption (wiping web).

The wiping of the nozzle face by the wiping web is performed by, for example, pressing and contacting the wiping web wound around a pressure member such as a pressure roller to the nozzle face of an inkjet head that moves in a certain direction. In this case, whether to wipe out the nozzle face is switched by whether to contact the wiping web to the nozzle face.

In Patent Literatures 1 (Japanese Patent Application Laid-Open No. 2011-73145) and 2 (Japanese Patent Application Laid-Open No. 2010-240507), there is suggested a method of reciprocating a pressure member by a reciprocating mechanism as a method of switching the contact/separation of a wiping member to a nozzle face. Moreover, in Patent Literatures 3 (Japanese Patent Application Laid-Open No. 2011-83900) and 4 (Japanese Patent Application Laid-Open No. 2010-234667), there is suggested a method of switching the contact/separation of a wiping member to a nozzle face by reciprocating the entire wiping device by a reciprocating mechanism.

As a method of switching the contact/separation of a wiping member to a nozzle face, in addition, there is known a method of reciprocating an inkjet head.

By the way, the wiping of a nozzle face by a wiping web is normally performed while running the wiping web. Further, the running direction of this wiping web is normally set to a direction opposite to the relative movement direction of the nozzle face. That is, for example, in a case where the nozzle face is wiped out by pressing and contacting the wiping web to the nozzle face of a moving inkjet head by a pressure member, the nozzle face is wiped out by running the wiping web in the direction opposite to the movement direction of the inkjet head. Therefore, the direction in which the nozzle face can be wiped out is limited to one direction. Then, in Patent Literatures 3 and 4, it is suggested to switch the running direction of the wiping web by switching the direction of the entire wiping device.

SUMMARY OF THE INVENTION

However, there is a problem that when the direction of the entire wiping device is switched and the running direction of the wiping web is switched, the device becomes complicated and large.

Meanwhile, when the nozzle face of a reciprocating inkjet head is wiped out without switching the running direction of the wiping web, the following problem occurs. That is, normally, the wiping web is assumed to be configured to run in one direction by being wound from a supply shaft to a winding shaft. Therefore, there is a problem that when the running direction of the wiping web wound around a pressure member and the movement direction of the nozzle face become the same direction, the wiping web is pulled to the nozzle face and forcefully drawn out from the supply shaft and slack is caused in the wiping web.

Moreover, as mentioned above, the nozzle face is wiped out or not wiped out by switching the contact/separation of the wiping web to the nozzle face, but, when the entire wiping device is configured to be reciprocated to enable the contact/separation of the wiping web to the nozzle face, there is a disadvantage that the device becomes complicated and large.

Even in a case where the contact/separation of the wiping web to the nozzle face is switched by reciprocating a pressure roller, since a mechanism to reciprocate the pressure roller is additionally required, there is a disadvantage that the device becomes complicated and large.

Moreover, in a method of moving the inkjet head and performing the contact/separation of the wiping web to the nozzle face, there is a disadvantage that the back pressure of ink changes, the meniscus collapses and bubbles mix.

The present invention is made in view of such circumstances, and it is an object to provide a nozzle face wiping device and an image recording device that can wipe out a nozzle face in two directions by a simple mechanism and switch whether to wipe out the nozzle face by the simple mechanism.

Means for solving the problem is as follows.

The first mode is a nozzle face wiping device that relatively moves along a nozzle face of an ejection head and wipes out the nozzle face, including: a rotatable supply shaft; a wiping web that is wound in a roll manner and attached to the supply shaft; a winding shaft; a wiping web running drive device which winds the wiping web around the winding shaft and running the wiping web; a pressure member that presses and contacts the wiping web to the nozzle face while being wound by the wiping web that runs between the supply shaft and the winding shaft; and a braking device which brakes running of the wiping web on an upstream side of the pressure member with respect to a running direction of the wiping web.

According to the mode, it is possible to brake the running of the wiping web by the braking device on the upstream side (supply shaft side) of the pressure member. In a case where the running direction of the wiping web wound around the pressure member and the relative movement direction of the nozzle face are the same, it is possible to prevent the wiping web from being forcefully drawn out from the supply shaft by braking the running of the wiping web by the braking device. By this means, it is possible to wipe out the nozzle face from two directions.

The second mode is a mode in the nozzle face wiping device according to the first mode, further including: a running control device which controls the wiping web running drive device and the braking device and controlling the running of the wiping web at wiping, operating the wiping web running drive device without operating the braking device when the running direction of the wiping web wound around the pressure member is opposite to a movement direction of the nozzle face, and operating the braking device without operating the wiping web running drive device when the running direction of the wiping web wound around the pressure member is identical to the movement direction of the nozzle face.

According to the mode, the braking device and the wiping web running drive device are controlled according to the movement direction of the nozzle face. That is, in a case where the running direction of the wiping web is opposite to the movement direction of the nozzle face, the wiping web running drive device is operated without operating the braking device. By this means, it is possible to press the wiping web to the nozzle face while running the wiping web. Moreover, in a case where the running direction of the wiping web is the same as the movement direction of the nozzle face, the braking device is operated without operating the wiping web running drive device. That is, the movement of the wiping web is stopped on the upstream side of the pressure member. By this means, even if the wiping web is contacted to the nozzle face, it is possible to prevent the wiping web from being drawn out from the supply shaft.

The third mode is a mode in the nozzle face wiping device according to the first or second mode, further including: a pressure member support device which supports the pressure member to the nozzle face in a reciprocable manner; a biasing device which biases the pressure member to the nozzle face; and a tension giving device which gives tension to the wiping web and evacuating the pressure member from the nozzle face by controlling the wiping web running drive device and the braking device, and giving the tension to the wiping web by operating the wiping web running drive device in a state where the braking device is operated.

According to the mode, the pressure member is supported to the nozzle face in a reciprocable manner and biased toward the nozzle face. By this means, it is possible to appropriately press and contact the wiping web to the nozzle face.

Moreover, according to the mode, it is possible to give tension to the wiping web. By this means, it is possible to reciprocate the pressure member with respect to the nozzle face. That is, as mentioned above, since the pressure member is supported in a reciprocable manner with respect to the nozzle face and biased toward the nozzle face, when tension is given to the wiping web, the wiping web reciprocates according to the given tension (when high tension is given, the wiping web moves in an evacuation direction from the nozzle face.) By this means, it is possible to switch the contact/separation of the wiping web with respect to the nozzle face without reciprocating the whole of the nozzle face wiping device with respect to the nozzle face or reciprocating the ejection head with respect to the nozzle face wiping device.

Here, giving the tension to the wiping web by the tension giving device is performed by controlling the wiping web running drive device and the braking device, and the tension is given to the wiping web by operating the wiping web running drive device in a state where the braking device is operated. That is, the tension is given to the wiping web by stopping the movement of the wiping web on the upstream side of the pressure member and winding the wiping web around the winding shaft in this state. By this means, it is possible to easily give the tension to the wiping web.

The fourth mode is a mode in the nozzle face wiping device according to any one of the first to third modes, where the braking device brakes rotation of the supply shaft and brakes the running of the wiping web.

According to the mode, the rotation of the supply shaft is braked and the running of the wiping web is braked. By this means, it is possible to easily brake the running of the wiping web on the upstream side of the pressure member.

The fifth mode is a mode in the nozzle face wiping device according to the fourth mode, further including a rotation member that rotates in synchronization with the supply shaft, where the braking device includes: a braking member that contacts to the rotation member and brakes rotation of the rotation member; and a reciprocation drive device which reciprocates the braking member with respect to the rotation member and contacting/separating the braking member to/from the rotation member.

In the mode, the rotation of the supply shaft is braked by contacting the braking member to the rotation member that rotates in synchronization with the supply shaft. According to the mode, it is possible to easily brake the rotation of the supply shaft only by controlling the contact/separation of the braking member with respect to the rotation member.

The sixth mode is a mode in the nozzle face wiping device according to the fifth mode, where: the rotation member is a rotation gear that rotates in synchronization with the supply shaft; the braking member is a fixed gear that cannot rotate; and the fixed gear is engaged with or disengaged from the rotation gear by the reciprocation drive device.

In the mode, the rotation of the supply shaft is braked by engaging the fixed gear with the rotation gear that rotates in synchronization with the supply shaft. According to the mode, it is possible to brake the rotation of the supply shaft easily and reliably only by controlling the engagement/disengagement of the fixed gear with respect to the rotation gear.

The seventh mode is a mode in the nozzle face wiping device according to the fifth or sixth mode, further including: a casing that includes the supply shaft, the wiping web, the winding shaft, the pressure member and the rotation member; and a device body including a drive source of the wiping web running drive device and the braking device, to which the casing is detachably attached.

According to the mode, when the casing is attached to the body device, it is possible to drive the winding shaft and brake the supply shaft. It is possible to simplify the configuration on the casing side by including the drive source of the wiping web running drive device and the braking device in the body side.

The eighth mode is a mode in the nozzle face wiping device according to any one of the first to seventh modes, further including: a rotation detection device which detects the rotation of the supply shaft; and a warning device which generates warning when the rotation of the supply shaft is detected by the rotation detection device while drive of the winding shaft by the wiping web running drive device stops.

According to the mode, the rotation of the supply shaft is detected by the rotation detection device, and the trouble of the device is detected on the basis of the detection result. That is, when the rotation of the supply shaft is detected by the rotation detection device while the drive of the winding shaft by the wiping web running drive device stops, since the wiping web is assumed to be drawn out from the supply shaft though the wiping web is not wound by the winding shaft, it is possible to determine that there is a trouble. When this trouble is detected, warning is generated by the warning device. By this means, it is possible to detect the trouble at an early stage.

The ninth mode is a nozzle face wiping device that cleans a nozzle face of an ejection head, including: a wiping web that is contacted to the nozzle face and wipes out the nozzle face; a wiping web running drive device which runs the wiping web along a longitudinal direction; a pressure member that presses and contacts the wiping web to the nozzle face; a biasing device which gives force to press the wiping web to the nozzle face through the pressure member; and a tension giving device which gives tension to the wiping web by making running speed on a downstream side of the wiping web with respect to the pressure member faster than running speed on an upstream side of the wiping web, and moving the pressure member in a direction against biasing force of the biasing device, where whether to wipe out the nozzle face is switched by giving the tension.

According to the mode, it is possible to give tension to the wiping web by making the running speed on the downstream side of the wiping web with respect to the pressure member faster than the running speed on the upstream side, and it is possible to move the pressure member in a direction against the biasing force of the biasing device, that is, to a side opposite to the nozzle face of the ejection head. Since the wiping web does not contact to the nozzle face by moving the pressure member to the side opposite to the nozzle face, it is possible to move the ejection head without wiping out the nozzle face. Therefore, it is possible to easily perform evacuation operation of the pressure member by giving tension to the wiping web.

The tenth mode is an image recording device including: a transportation portion that transports a recording medium; an ejection head that ejects an ink drop to the recording medium transported by the transportation portion and forms an image; and a nozzle face wiping device according to any one of claims 1 to 9 that cleans a nozzle face of the ejection head.

According to the mode, since the nozzle face wiping device is included, it is possible to improve the ejection stability. Moreover, since the pressure member of the nozzle face wiping device is moved up and down and the ejection head is not moved up and down, it is possible to stabilize the meniscus.

According to the present invention, it is possible to wipe out a nozzle face in two directions by a simple mechanism and switch whether to wipe out the nozzle face by the simple mechanism.

DETAILED DESCRIPTION OF THE EMBODIMENTS

In the following, preferable embodiments of the present invention are described according to the accompanying drawings.

[First Embodiment]

<<Inkjet Printing Device>>

<Configuration of Inkjet Head>

Figure 1:
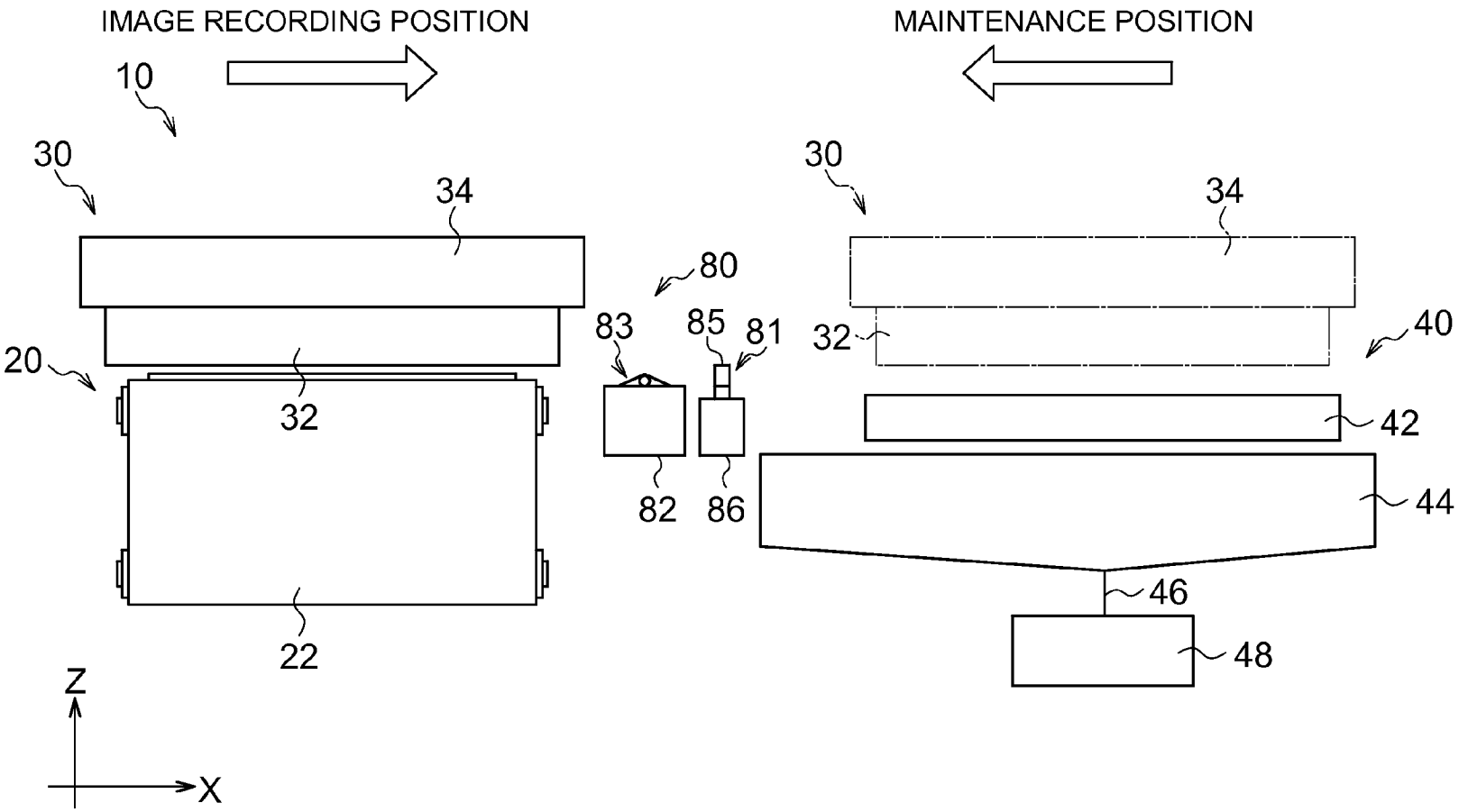
FIG. 1 is a front view illustrating the configuration of main components of an inkjet printing device.
Figure 2:
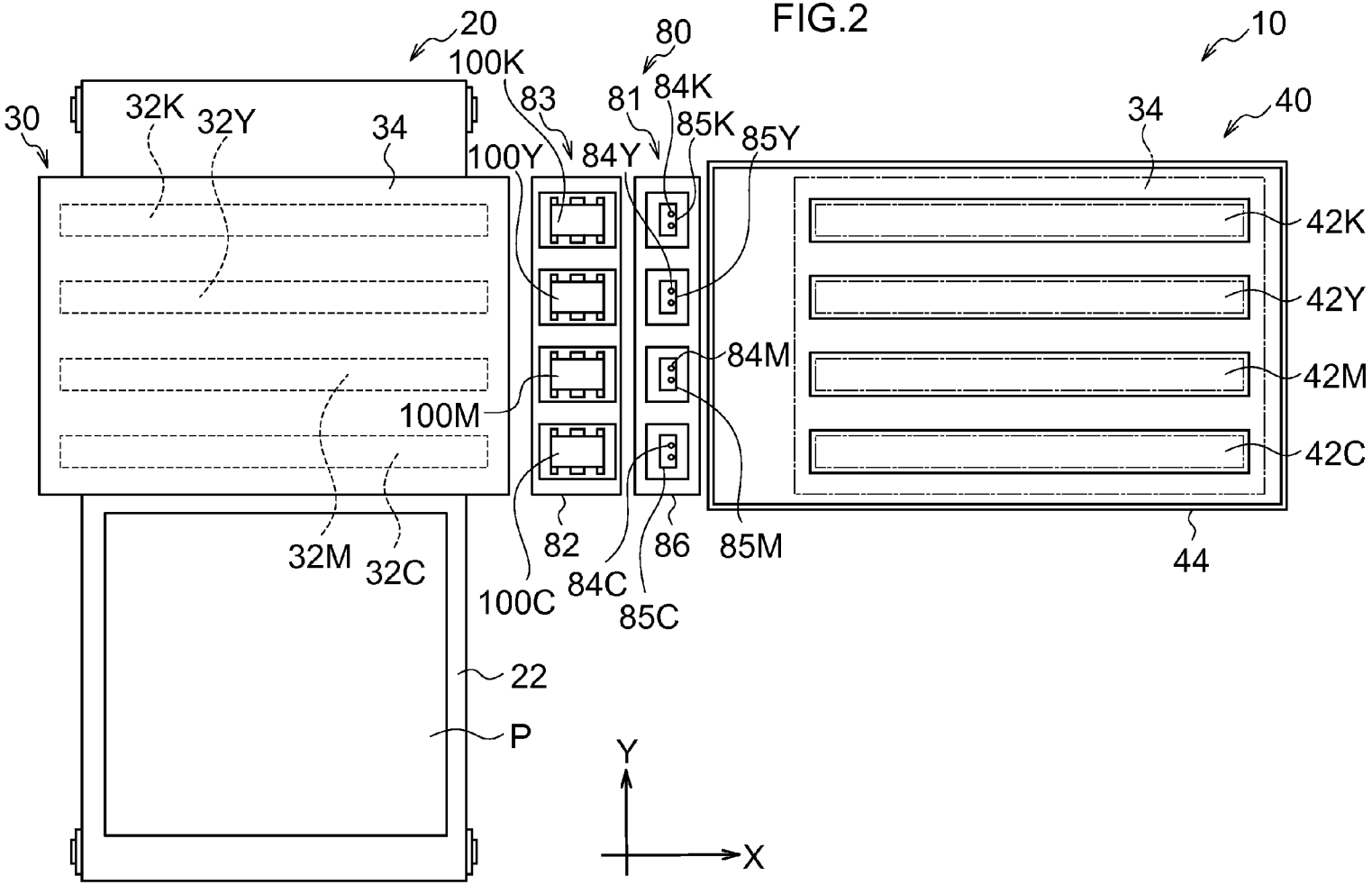
FIG. 2 is a plan view illustrating the configuration of main components of an inkjet printing device.
Figure 3:
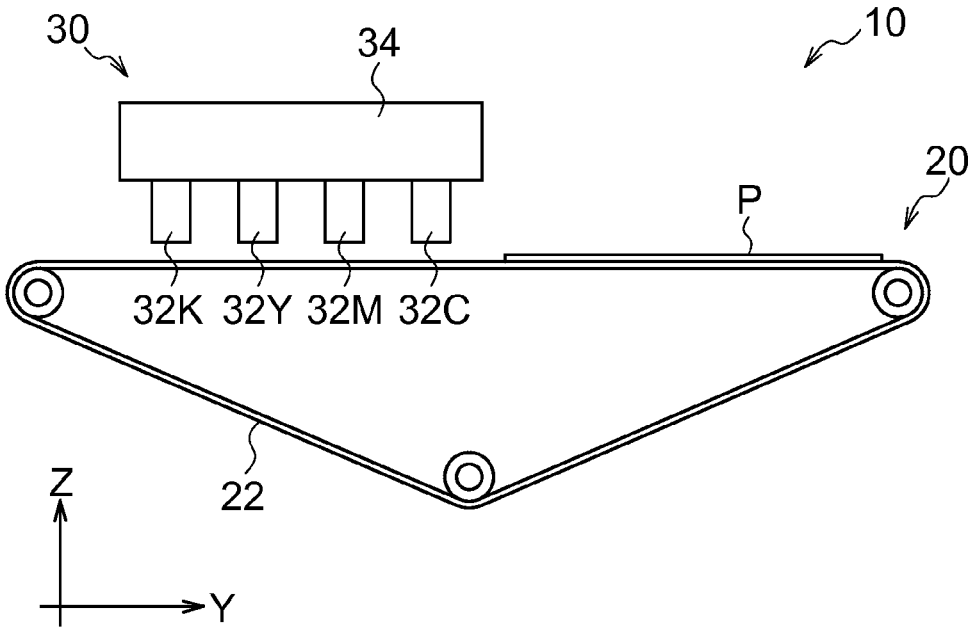
FIG. 3 is a side view illustrating the configuration of main components of an inkjet printing device.

FIGS. 1 to 3 are a front view, plan view and side view illustrating the configuration of main components of an inkjet printing device as one example of an image recording device of the present embodiment.

As illustrated in the figures, this inkjet printing device 10 (image recording device) is a line printer of a single pass system, and mainly includes a paper transportation portion 20 that transports paper (flat paper) P that is a recording medium, a head unit 30 including multiple inkjet heads (hereinafter referred to as "head"), a maintenance portion 40 that performs maintenance of each head included in the head unit 30, and a nozzle face cleaning portion 80 that cleans the nozzle face of each head included in the head unit 30.

The paper transportation portion 20 performs belt transportation of paper P. That is, paper P is adsorbed to a running belt 22, and paper P is transported. A running path is set such that the belt 22 horizontally runs in a partial area. The paper transportation portion 20 uses the part in which the belt 22 horizontally runs, and horizontally transports paper P. Paper P is transported in a certain direction (Y direction) in a horizontal posture by this paper transportation portion 20.

The head unit 30 includes a head 32C that ejects an ink drop of cyanogen, a head 32M that ejects an ink drop of magenta, a head 32Y that ejects an ink drop of yellow, a head 32K that ejects an ink drop of black and a head support frame 34 to which each of the heads 32C, 32M, 32Y and 32K is attached.

The heads 32C, 32M, 32Y and 32K as ejection heads are configured with line heads corresponding to the maximum paper width of paper P as a printing target. Here, since the configurations of respective heads 32C, 32M, 32Y and 32K are the same, in the following, an explanation is given assuming them as a head 32 except when they are especially distinguished.

The head 32 has a rectangular block shape and includes a nozzle face 33 (33C, 33M, 33Y, 33K) in the bottom.

Figure 4:
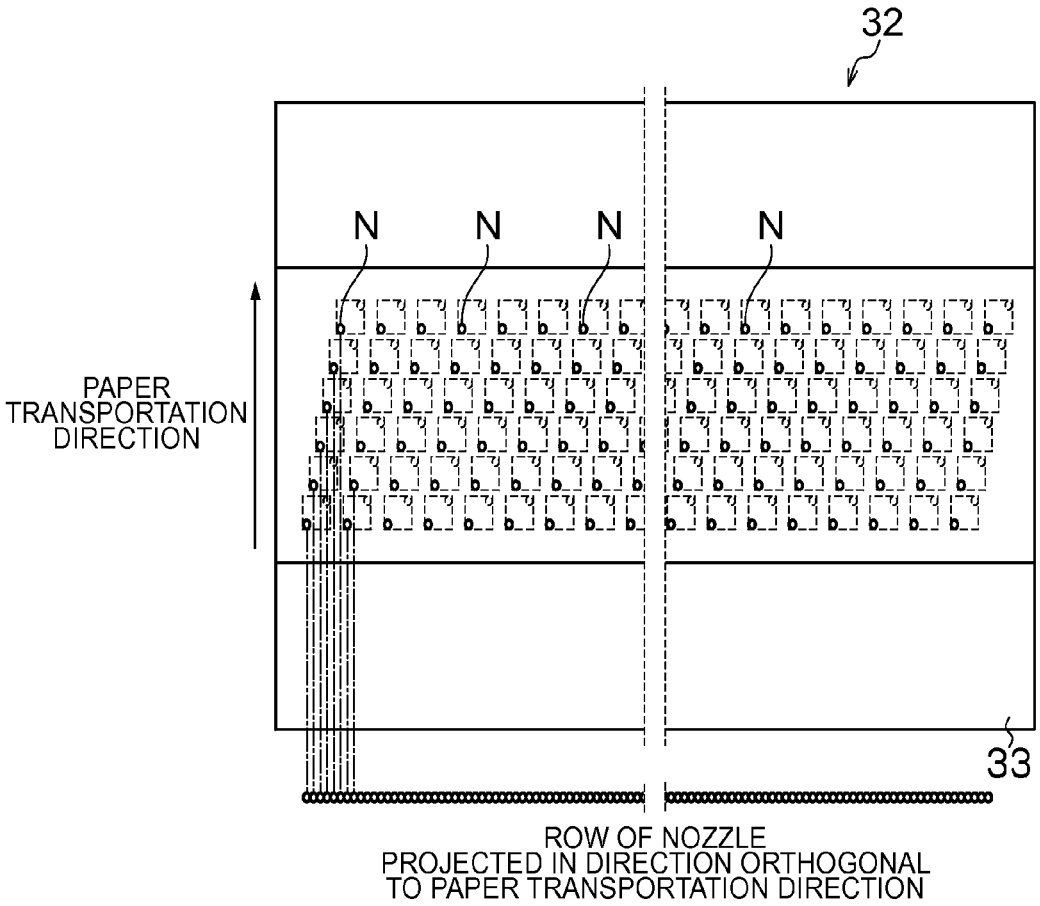
FIG. 4 is a plan perspective view of a nozzle face of a head.

FIG. 4 is a plan perspective view of the nozzle face of the head.

The nozzle face 33 has a rectangular shape. In the nozzle face 33, a nozzle is arrayed along the longitudinal direction. In the present embodiment, nozzle N is disposed in a two-dimensional matrix manner. By disposing nozzle N in this way, it is possible to narrow the actual interval of nozzle N projected to the longitudinal direction of the head 32 and achieve the densification of nozzle N. Liquid repellent processing is applied to the nozzle face 33 (for example, a liquid repellent film is included on the surface).

The head 32 causes an ink drop to be ejected from nozzle N in a so-called piezo system. Each nozzle N communicates with a pressure room, and, by vibrating the wall surface of this pressure room by piezo elements (piezoelectric elements), the ink drop is caused to be ejected from nozzle N. Here, a system to eject an ink drop is not limited to this, and, for example, a configuration in which the ink drop is ejected in a thermal system is also possible.

The head support frame 34 includes a head attachment portion (not illustrated) to attach each head 32. Each head 32 is detachably attached to this head attachment portion.

When each head 32 is attached to the head support frame 34, each head 32 is disposed so as to be orthogonal to the transportation direction of paper P (disposed along the X direction). Moreover, when each head 32 is attached to the head support frame 34, the nozzle face 33 is horizontally disposed (disposed in parallel to the XY plane). Moreover, when each head 32 is attached to the head support frame 34, it is disposed at regular intervals along the transportation direction (Y direction) of paper P.

The head attachment portion is installed such that the position in the vertical direction (Z direction) can be adjusted. As for each head 32 attached to the head attachment portion, the height position of the nozzle face 33 is adjusted by adjusting the height position (position in the Z direction) of the head attachment portion.

The head moving mechanism horizontally moves the head unit 30 in a direction (X direction) orthogonal to the transportation direction (Y direction) of paper P.

This head moving mechanism includes, for example, a ceiling frame horizontally installed over the paper transportation portion 20, a guide rail laid to the ceiling frame, a running body that slides and moves on the guide rail, and a drive device (for example, a feed screw mechanism formed with a feed screw and a motor that rotates and drives the feed screw, and so on) for moving the running body along the guide rail. The head support frame 34 is attached to the running body, and the head unit 30 horizontally slides and moves.

Each head 32 included in the head unit 30 is horizontally moved between a predetermined "image recording position" and "maintenance position" when the head unit 30 is driven by the head moving mechanism and horizontally moves.

When the head 32 is positioned in the image recording position, the head 32 is positioned above the paper transportation portion 20. By this means, it becomes possible to eject an ink drop from each head 32 toward paper P transported by the paper transportation portion 20, and it becomes possible to form an image on paper P transported by the paper transportation portion 20.

A cap 42 (42C, 42M, 42Y, 42K) that covers a nozzle face 33 of each head 32 is included in the maintenance portion 40.

When the head 32 is positioned in the maintenance position, it is positioned above the cap 42. In a case where the device is stopped for a long time, and so on, the head unit 30 is moved to the maintenance position, and the nozzle face 33 of the head 32 is covered with the cap 42. By this means, non-ejection by dryness is prevented.

The cap 42 includes a pressurization/suction mechanism (not illustrated) to perform pressurization/suction in the nozzle, and a cleaning solution supply mechanism (not illustrated) to supply a cleaning solution into the cap 42, and so on. Moreover, a waste liquid tray 44 is disposed in the lower position of the cap 42. The cleaning solution supplied to the cap 42 is abandoned to this waste liquid tray 44 and collected from the waste liquid tray 44 to a waste liquid tank 48 through a waste liquid collection piping 46.

The nozzle face cleaning portion 80 is installed on the transfer pathway of the head unit 30. The nozzle face cleaning portion 80 includes a cleaning solution giving unit 81 that gives a cleaning solution to the nozzle face 33 of the head 32, and a nozzle face wiping unit 83 that wipes out the nozzle face 33 of the head 32.

When the head 32 moves between the maintenance position and the image recording position, the cleaning solution giving unit 81 gives the cleaning solution to the nozzle face 33.

When the head 32 moves between the maintenance position and the image recording position, the nozzle face wiping unit 83 wipes out the nozzle face 33.

Here, the configuration of this nozzle face cleaning portion 80 is described later in detail.

<Operation of Inkjet Printing Device>

Paper P is horizontally transported along one direction by the paper transportation portion 20. Paper P passes below the head unit 30 positioned in the image recording device. When paper P passes below this head unit 30, an ink drop is ejected from each head 32 included in the head unit 30 to paper P. By this means, an image is recorded on paper P.

<<Nozzle Face Cleaning Portion>>

The nozzle face cleaning portion 80 includes the cleaning solution giving unit 81 and the nozzle face wiping unit 83.

<Cleaning Solution Giving Unit>

[Configuration of Cleaning Solution Giving Unit]

The cleaning solution giving unit 81 includes cleaning solution giving nozzles 84C, 84M, 84Y and 84K that individually give a cleaning solution to the nozzle faces 33C, 33M, 33Y and 33K of respective heads 32C, 32M, 32Y and 32K included in the head unit 30. Respective cleaning solution giving nozzles 84C, 84M, 84Y and 84K are installed in a common base 86 according to the installation interval of the heads 32C, 32M, 32Y and 32K.

Here, since the configurations of respective 84C, 84M, 84Y and 84K are the same, in the following, an explanation is given assuming them as a cleaning solution giving nozzle 84 except when they are especially distinguished.

The cleaning solution giving nozzle 84 has a block shape and includes a cleaning solution holding surface 85 (85C, 85M, 85Y, 85K) that is horizontal to the upper surface part. The cleaning solution holding surface 85 has a cleaning solution jet hole (not illustrated). When a cleaning solution is supplied from a cleaning solution supply device (not illustrated) to the cleaning solution giving nozzle 84, the cleaning solution is jetted from this cleaning solution jet hole. The cleaning solution holding surface 85 plays a role to hold the cleaning solution jetted from this cleaning solution jet hole.

The head 32 passes above the cleaning solution giving nozzle 84 by moving between the image recording position and the maintenance position. When the head 32 passes over the cleaning solution giving nozzle 84, the cleaning solution held on the cleaning solution holding surface 85 contacts the nozzle face 33 of the head 32, and the cleaning solution is given to the nozzle face 33.

The cleaning solution supply device (not illustrated) supplies the cleaning solution to respective cleaning solution giving nozzles 84C, 84M, 84Y and 84K. The cleaning solution supply device includes, for example, a cleaning solution tank that accumulates a cleaning solution, cleaning solution supply piping that connects the cleaning solution tank and the cleaning solution giving nozzle 84, a cleaning solution valve included in the cleaning solution supply piping, and a cleaning solution supply pump that sends a cleaning solution from the cleaning solution tank to the cleaning solution giving nozzle 84 through the cleaning solution supply piping. In a case where the cleaning solution is supplied to the cleaning solution giving nozzle 84, the cleaning solution valve is opened and the cleaning solution supply pump is driven. By this means, the cleaning solution accumulated in the cleaning solution tank is supplied to the cleaning solution giving nozzle 84 through the cleaning solution supply piping.

[Operation of Cleaning Solution Giving Device]

The cleaning solution is given to the nozzle face 33 by moving the head unit 30 to pass above the cleaning solution giving unit 81.

When the cleaning solution is supplied from the cleaning solution supply device to the cleaning solution giving nozzle 84, the cleaning solution is jetted from the cleaning solution jet hole included in the cleaning solution holding surface 85. The jetted cleaning solution is held on the cleaning solution holding surface 85.

When the head 32 passes above the cleaning solution giving nozzle 84, the nozzle face 33 contacts the cleaning solution held on the cleaning solution holding surface 85. By this means, the cleaning solution is given to the nozzle face 33.

Thus, the cleaning solution giving unit 81 gives the cleaning solution to the nozzle face 33 by making the nozzle face 33 contact to the cleaning solution held on the cleaning solution holding surface 85.

<Nozzle Face Wiping Unit>

The nozzle face wiping unit 83 includes nozzle face wiping devices 100C, 100M, 100Y and 100K that individually wipe out nozzle faces 33C, 33M, 33Y and 33K of respective heads 32C, 32M, 32Y and 32K included in the head unit 30. Respective nozzle face wiping devices 100C, 100M, 100Y and 100K are installed in a common base 82 according to the installation interval of the heads 32C, 32M, 32Y and 32K.

Here, since the configurations of respective nozzle face wiping devices 100C, 100M, 100Y and 100K are the same, in the following, an explanation is given assuming them as a nozzle face wiping device 100 except when they are especially distinguished.

[Configuration of Nozzle Face Wiping Device]

Figure 5:
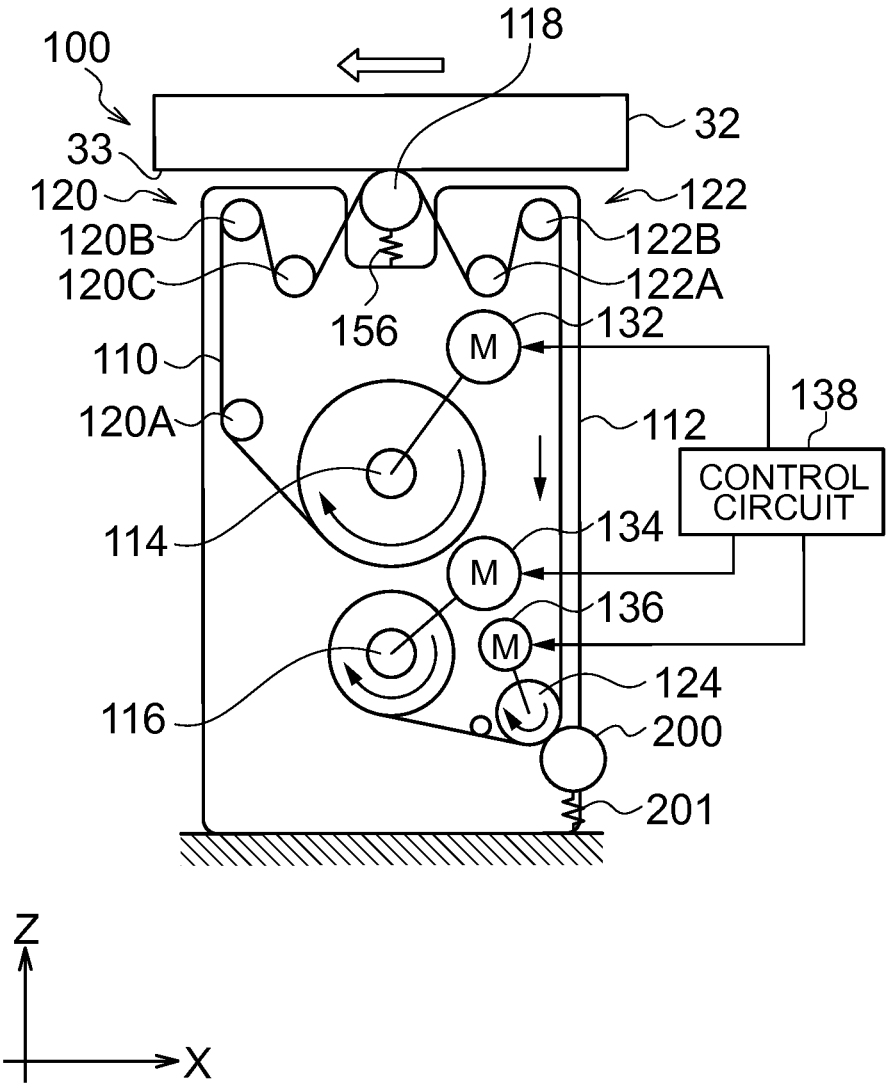
FIG. 5 is a front cross-sectional view illustrating a schematic configuration of the first embodiment of a nozzle face wiping device.

FIG. 5 is a front cross-sectional view illustrating the schematic configuration of the nozzle face wiping device 100.

The nozzle face wiping device 100 wipes out the nozzle face 33 by pressing and contacting a wiping web 110 to the nozzle face 33 of the head 32 that moves along the longitudinal direction.

The nozzle face wiping device 100 includes a casing 112 that houses the wiping web 110, a supply shaft 114 that sends the wiping web 110, a winding shaft 116 that winds the wiping web 110, a pressure roller 118 that presses and contacts the wiping web 110 to the nozzle face 33, a previous-stage guide portion 120 that guides the running of the wiping web 110 between the supply shaft 114 and the pressure roller 118, a subsequent-stage guide portion 122 that guides the running of the wiping web 110 between the pressure roller 118 and a feed roller 124, a feed roller 124 that gives a feed to the wiping web 110, a nip roller 200 that nips the wiping web 110 with the feed roller 124, a supply shaft rotation drive motor 132 that rotates and drives the winding shaft 116, a winding shaft rotation drive motor 134 that rotates and drives the winding shaft 116, a feed roller rotation drive motor 136 that rotates and drives the feed roller 124, and a control circuit 138 that controls the drive of each motor.

The wiping web 110 is configured with a belt-like sheet member having absorption (for example, a sheet member formed by knitting or weaving by the use of ultra-minute fiber such as PET (Polyethylene terephthalate), PE (Polyethylene), NY (Nylon) and acrylic). The width of the wiping web 110 corresponds to the width in the short side direction of the nozzle face 33 of the head 32 that is a wiping object (width in a direction orthogonal to the movement direction of the head 32), which is a width identical or substantially identical to the width.

The supply shaft 114 is rotatably supported by bearings (not illustrated) included in the casing 112. The supply shaft 114 is disposed so as to be orthogonal to the movement direction of the head 32 and horizontally disposed (disposed along the Y direction). A reel (not illustrated) is detachably attached to the supply shaft 114. The wiping web 110 is wound around this reel in a rolled manner and attached to the supply shaft 114.

The winding shaft 116 is rotatably supported by bearings (not illustrated) included in the casing 112. The winding shaft 116 is disposed so as to be orthogonal to the movement direction of the head 32 and horizontally disposed (disposed along the Y direction). A reel (not illustrated) is detachably attached to the winding shaft 116. The wiping web 110 is wound around the reel attached to the winding shaft 116 in a rolled manner.

The pressure roller (pressure member) 118 is rotatably supported by a shaft support portion 146 included in the casing 112 in a vertically movable manner. The pressure roller 118 is disposed so as to be orthogonal to the movement direction of the head 32 and horizontally disposed (disposed along the Y direction). The wiping web 110 is pressed and contacted to the nozzle face 33 of the head 32 through this pressure roller 118.

Here, the pressure roller 118 is rotatably supported by the shaft support portion 146 in a vertically movable manner in a state where it is biased in the upper direction (direction in which it is pressed and contacted to the nozzle face 33). This point is described later.

The previous-stage guide portion 120 includes multiple guide rollers 120A, 120B and 120C arranged in predetermined positions of the casing 112. Respective guide rollers 120A, 120B and 120C are rotatably supported by bearings (not illustrated) included in the casing 112. Respective guide rollers 120A, 120B and 120C are disposed so as to be orthogonal to the movement direction of the head 32 and horizontally disposed (disposed along the Y direction). The wiping web 110 is wound around respective guide rollers 120A, 120B and 120C, and runs between the supply shaft 114 and the pressure roller 118.

The subsequent-stage guide portion 122 includes multiple guide rollers 122A and 122B arranged in predetermined positions of the casing 112. Respective guide rollers 122A and 122B are rotatably supported by bearings (not illustrated) included in the casing 112. Respective guide rollers 122A and 122B are disposed so as to be orthogonal to the movement direction of the head 32 and horizontally disposed (disposed along the Y direction). The wiping web 110 is wound around respective guide rollers 122A and 122B, and runs between the pressure roller 118 and the feed roller 124.

Here, the number and setting positions and the like of guide members forming the previous-stage guide portion 120 and the subsequent-stage guide portion 122 are arbitrarily adjusted according to the setting positions and the like of the supply shaft 114, the winding shaft 116 and the pressure roller 118, and so on.

However, the running path is set such that the wiping web 110 is wound around the peripheral surface on the upper side of the pressure roller 118.

Moreover, it is preferable that guide members disposed in front of and behind the pressure roller 118 (the guide rollers 120C and 122A in the present embodiment) are symmetrically disposed such that the downward force is applied to the pressure roller 118 by the tension of the wiping web 110 wound around the pressure roller 118.

The feed roller 124 is rotatably supported by bearings (not illustrated) included in the casing 112. The feed roller 124 is disposed so as to be orthogonal to the movement direction of the head 32 and horizontally disposed (disposed along the Y direction). The feed roller 124 is driven by the feed roller rotation drive motor 136 and rotates. By this means, a feed is given to the wiping web 110 wound around the feed roller 124.

The nip roller 200 is rotatably supported by bearings (not illustrated) included in the casing 112 in a vertically movable manner. The nip roller 200 is disposed in parallel to the feed roller 124, biased by a spring 201 and pressed and contacted to the peripheral surface of the feed roller 124. The outer periphery of the nip roller 200 is covered with an elastic body such as rubber, and the nip roller 200 nips the wiping web 110 wound around the feed roller 124 with the feed roller 124. When the wiping web 110 is nipped by the nip roller 200, absorbed liquid is removed. The liquid removed from the wiping web 110 is collected by a waste liquid receiver (not illustrated) disposed in the lower part of the nip roller 200, and wasted to the waste liquid tank 48.

A supply shaft rotation drive motor 132 as the rotation drive source of the supply shaft 114 is included in the casing 112, and rotates and drives the supply shaft 114. The supply shaft 114 rotates by driving this supply shaft rotation drive motor 132. Moreover, the rotation of the supply shaft 114 is stopped by stopping the drive of this supply shaft rotation drive motor 132. By this means, feeding of the wiping web 110 is stopped (a brake is applied to feeding). That is, the supply shaft rotation drive motor 132 also functions as a braking device, and brakes the running of the wiping web 110 on the upstream side of the pressure roller 118.

The winding shaft rotation drive motor 134 as a rotation drive source of the winding shaft 116 is included in the casing 112, and rotates and drives the winding shaft 116.

The feed roller rotation drive motor 136 as a rotation drive source of the feed roller 124 is included in the casing 112, and rotates and drives the feed roller 124.

The control circuit 138 controls the drive of the supply shaft rotation drive motor 132, the winding shaft rotation drive motor 134 and the feed roller rotation drive motor 136, and controls the running of the wiping web 110.

Therefore, in the nozzle face wiping device 100 of the present embodiment, the supply shaft 114, the supply shaft rotation drive motor 132, the winding shaft 116, the winding shaft rotation drive motor 134, the feed roller 124 and the feed roller rotation drive motor 136 form the wiping web running drive device.

Moreover, as described later, the control circuit 138 can control the tension applied to the wiping web 110 by controlling the drive of the supply shaft rotation drive motor 132, the winding shaft rotation drive motor 134 and the feed roller rotation drive motor 136. The control circuit 138 functions as a running control device which controls the running of the wiping web 110, and also functions as a tension giving device.

[Configuration of Shaft Support Portion]

Figure 6:
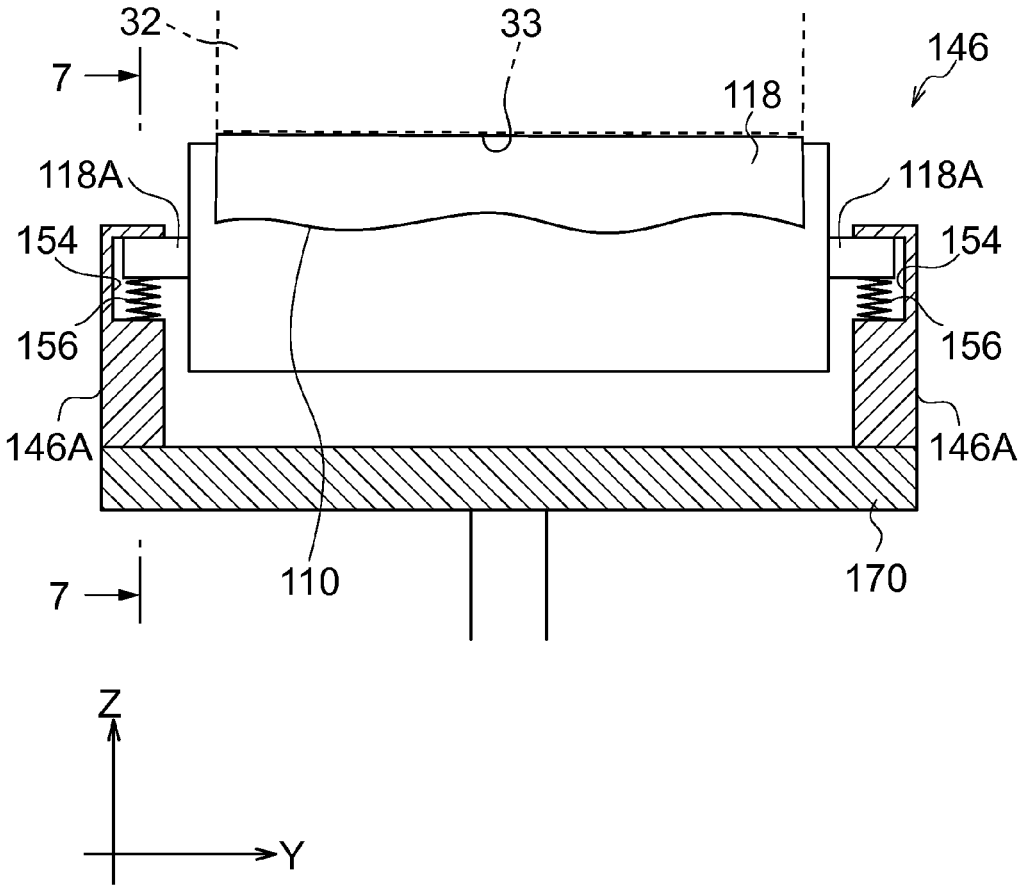
FIG. 6 is a partial cross-sectional view illustrating the configuration of a shaft support portion that supports the shaft portion of a pressure roller.
Figure 7:
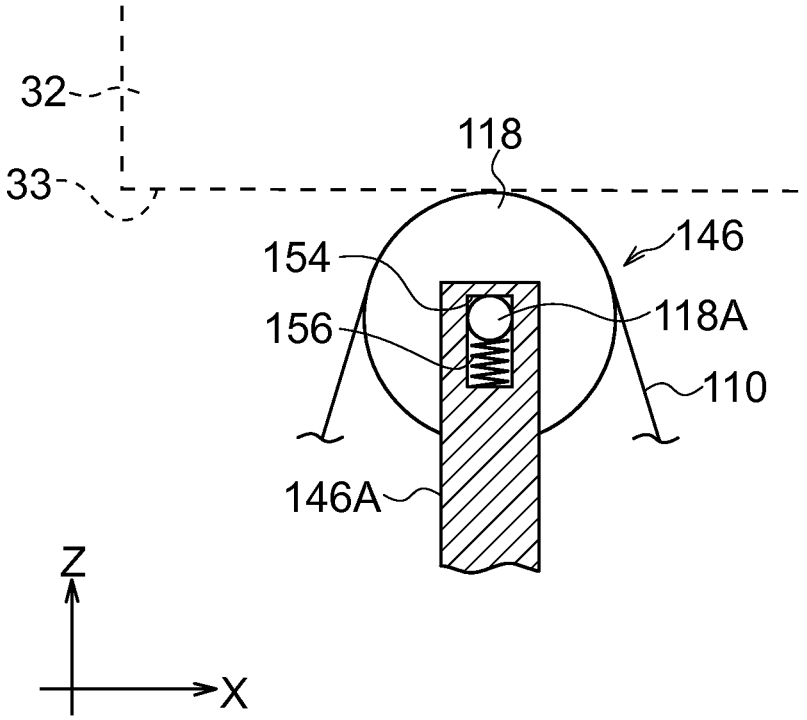
FIG. 7 is a cross-sectional view of 7-7 of FIG. 6.

FIG. 6 is a partial cross-sectional view illustrating the configuration of a shaft support portion that supports the shaft portion of a pressure roller. Moreover, FIG. 7 is a cross-sectional view of 7-7 in FIG. 6.

The pressure roller 118 has a shaft portion 118A that projects to both end portions. In the pressure roller 118, this shaft portion 118A is rotatably supported in a vertically movable manner by the shaft support portion 146 (a pressure member support device).

The shaft support portion 146 includes a pair of shaft support members 146A. The shaft support members 146A are vertically installed on a horizontal stage 170.

Each of the pair of shaft support members 146A has a rectangular board shape and is disposed so as to be orthogonal to the shaft of the pressure roller 118. Each of the pair of shaft support members 146A has a concave portion 154 near the top of mutually facing surfaces. The concave portion 154 has a rectangular groove shape having substantially the same width as the width (diameter) of the shaft portion 118A of the pressure roller 118, and is disposed along the vertical direction (Z direction) (disposed so as to be orthogonal to the nozzle face 33 of the head 32 (see FIG. 7)).

In the pressure roller 118, the shaft portion 118A on both ends thereof is fitted to the concave portion 154, and the shaft portion 118A is supported so as to be rotatable with respect to the shaft support portion 146 and reciprocable in the vertical direction (direction orthogonal to the nozzle face 33).

Each spring 156 as a biasing device is housed in the concave portion 154. The shaft portion 118A is biased in the upper direction (direction toward the nozzle face 33) by this spring 156.

Thus, when the shaft portion 118A on both ends is supported by the shaft support portion 146, the pressure roller 118 is supported so as to be movable in the vertical direction and rotatable while being biased in the upper direction.

[Contact/separation Operation of Pressure Roller]

When the pressure roller 118 supported as mentioned above gives high tension to the wiping web 110, the pressure roller 118 moves in the lower direction against the biasing force of the spring 156.

The tension of the wiping web 110 wound around the pressure roller 118 can be adjusted by controlling the running speed of the wiping web 110 that runs on the upstream side of the pressure roller 118 (feed amount on the upstream side) and the running speed of the wiping web 110 that runs on the downstream side of the pressure roller 118 (feed amount on the downstream side).

For example, when the running speed on the downstream side of the pressure roller 118 is made faster than the running speed on the upstream side of the pressure roller 118 (when the feed amount of the wiping web 110 on the upstream side of the pressure roller 118 is made larger than the feed amount on the downstream side), it is possible to increase the tension of the wiping web 110 wound around the pressure roller 118 as compared with when they are the same running speed. By contrast, when the running speed on the downstream side of the pressure roller 118 is made slower than the running speed on the upstream side of the pressure roller 118 (when the feed amount of the wiping web 110 on the upstream side of the pressure roller 118 is made larger than the feed amount on the downstream side), it is possible to decrease the tension of the wiping web 110 wound around the pressure roller 118 as compared with when they are the same running speed.

Thus, by controlling the running speed of the wiping web 110 that runs on the upstream side of the pressure roller 118 (feed amount on the upstream side) and the running speed of the wiping web 110 that runs on the downstream side of the pressure roller 118 (feed amount on the downstream side), it is possible to adjust the tension of the wiping web 110 wound around the pressure roller 118.

Further, the position of the pressure roller 118 can be controlled by controlling the tension of this wiping web 110, and the contact/separation of the wiping web 110 with respect to the nozzle face 33 can be controlled. That is, if higher tension is applied to the wiping web 110 than when the pressure roller 118 contacts to the nozzle face 33, it is possible to separate the pressure roller 118 from the nozzle face 33.

For this, it only has to make the running speed of the wiping web 110 on the downstream side of the pressure roller 118 faster than the running speed on the upstream side (it only has to make the feed amount on the downstream side larger than the feed amount on the upstream side). Further, it only has to make the rotation speed of the winding shaft 116 and the feed roller 124 faster to make the running speed of the wiping web 110 on the downstream side of the pressure roller 118 faster than the running speed on the upstream side. Alternatively, it only has to slow down the rotation speed of the supply shaft 114. By this means, the feed amount on the downstream side of the pressure roller 118 becomes larger than the feed amount on the upstream side, and it is possible to increase the tension of the wiping web 110 wound around the pressure roller 118.

Besides this, even by a method of stopping the supply shaft 114 or reversely rotating the supply shaft 114, and so on, it is possible to increase the tension of the wiping web 110 wound around the pressure roller 118.

[Operation of Nozzle Face Wiping Device]

As mentioned above, in the nozzle face wiping device 100 of the present embodiment, the contact/separation of the pressure roller 118 (contact/separation of the wiping web 110) with respect to the nozzle face 33 is controlled by the tension given to the wiping web 110.

Specifically, higher tension is given to the wiping web 110 than when it is pressed and contacted to the nozzle face 33, and the pressure roller 118 is separated from the nozzle face 33.

Here, the tension of the wiping web 110 when the pressure roller 118 is pressed and contacted to the nozzle face 33 is assumed to be T1. This tension T1 is set to tension to the extent that the pressure roller 118 is slightly depressed from the top dead center. That is, T1 is set to a level to the extent that the pressure roller 118 is depressed when higher tension is applied.

Here, the top dead center of the pressure roller 118 is a position in which the shaft portion 118A contacts to the upper end part of the concave portion 154.

Moreover, the position of the pressure roller 118 when tension T1 is applied to the wiping web 110 is assumed to be wiping position P1. This wiping position P1 is set to a position in which P1 contacts to the nozzle face 33 of the head 32 that moves between the image recording position and the maintenance position.

When the nozzle face 33 is wiped out, the control circuit 138 drives the supply shaft rotation drive motor 132, the winding shaft rotation drive motor 134 and the feed roller rotation drive motor 136 such that tension T1 is applied to the wiping web 110, and makes the wiping web 110 run in the winding direction of the winding shaft 116.

By this means, as illustrated in FIG. 5, when the head 32 is moved, the wiping web 110 wound around the pressure roller 118 is pressed and contacted to the nozzle face 33 of the moving head 32, and the nozzle face 33 is wiped out by the wiping web 110.

Here, the wiping web 110 is pressed and contacted to the nozzle face 33 while running. The running direction of the wiping web 110 at this time is a direction in which the wiping web 110 is wound around the winding shaft 116. Further, the running direction of the wiping web 110 in a wiping portion, that is, the running direction of the wiping web 110 in a part wound around the pressure roller 118 is a direction along the movement direction of the head 32, and is the same direction as the movement direction when the head 32 moves from the image recording position to the maintenance position.

Therefore, in a case where the head 32 is moved from the maintenance position to the image recording position, the wiping web 110 is pressed and contacted to the nozzle face 33 while running in a direction opposite to the movement direction of the head 32.

On the other hand, in a case where the head 32 is moved from the maintenance position to the image recording position, the wiping web 110 is pressed and contacted to the nozzle face 33 while running in the same direction as the movement direction of the head 32.

Figure 8:
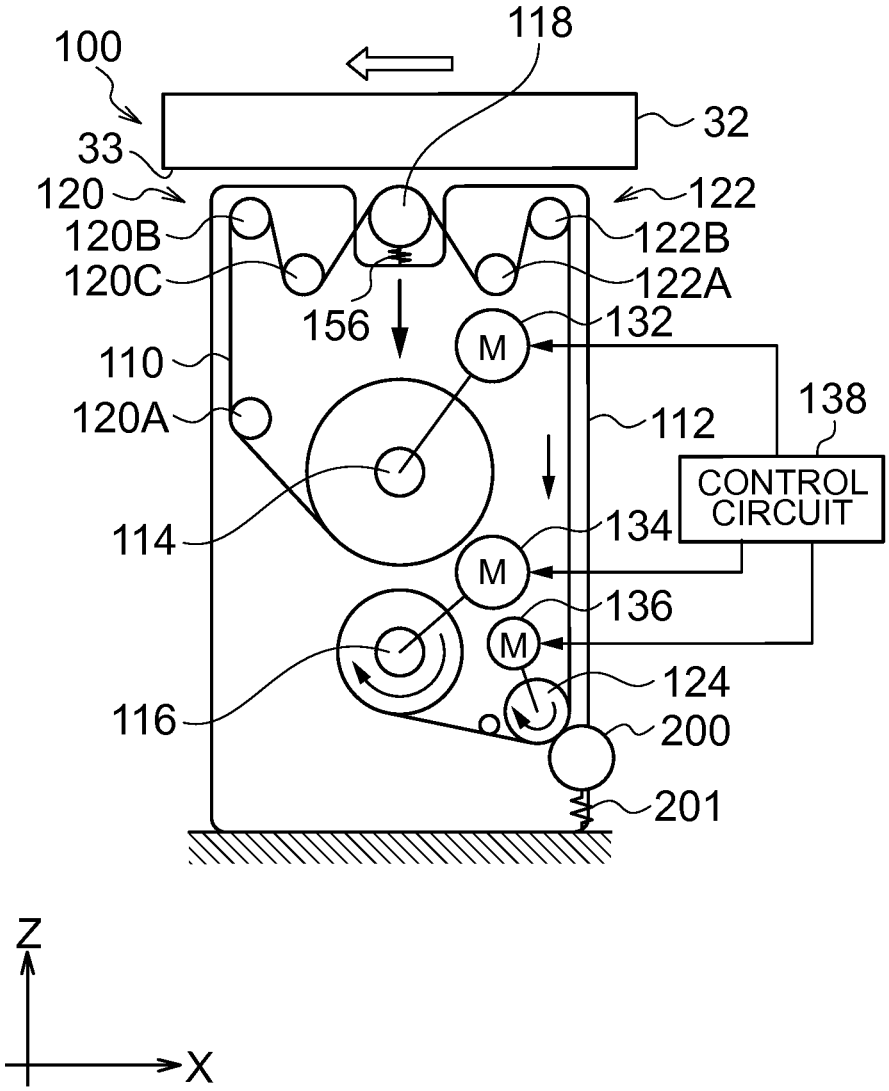
FIG. 8 is an operation explanatory diagram of a nozzle face wiping device of the first embodiment.

When the nozzle face 33 is not wiped out, higher tension than tension T1 is applied to the wiping web 110 to depress the pressure roller 118. By this means, as illustrated in FIG. 8, it is possible to separate the pressure roller 118 from the nozzle face 33 of the head 32.

Here, the tension of the wiping web 110 when the pressure roller 118 is separated is assumed to be T2. This tension T2 is set higher than tension T1 when the pressure roller 118 is contacted to the nozzle face 33, and T2 is set to a level at which it is possible to depress the pressure roller 118 against the biasing force of the spring 156.

The control circuit 138 drives the supply shaft rotation drive motor 132, the winding shaft rotation drive motor 134 and the feed roller rotation drive motor 136 such that tension T2 is applied to the wiping web 110, and generates tension T2 in the wiping web 110. Specifically, by making the rotation speed of the winding shaft 116 and the feed roller 124 faster or slowing down the rotation speed of the supply shaft 114, the running speed of the wiping web 110 on the downstream side of the pressure roller 118 is made faster than the running speed on the upstream side, and tension T2 is generated in the wiping web 110. Alternatively, tension T2 is generated in the wiping web 110 by stopping the supply shaft 114 or reversely rotating the supply shaft 114.

By this means, the pressure roller 118 is depressed by the tension of the wiping web 110, and the pressure roller 118 is separated from the nozzle face 33 of the head 32.

By separating the pressure roller 118 from the nozzle face 33 of the head 32, it is possible to prevent the wiping web 110 from contacting to the nozzle face 33 of the head 32 that moves between the image recording position and the maintenance position. That is, it is possible to move the head 32 without wiping out the nozzle face 33.

<<Cleaning Method of Nozzle Face by Nozzle Face Cleaning Portion>>

The cleaning of the nozzle face 33 is performed by moving the head 32 from the maintenance position to the image recording position.

When the head 32 is moved from the maintenance position to the image recording position, the head 32 passes above the cleaning solution giving nozzle 84 and the nozzle face wiping device 100. A cleaning solution is given to the nozzle face 33 when the head 32 passes above the cleaning solution giving nozzle 84, and the nozzle face 33 is wiped out when the head 32 passes above the nozzle face wiping device 100.

When the tip of the head 32 (end part on the image recording position side) moves to a portion in front of the cleaning solution giving nozzle 84, the cleaning solution is supplied from the cleaning solution supply device to the cleaning solution giving nozzle 84. By this means, the cleaning solution is supplied onto the cleaning solution holding surface 85.

The head 32 passes above this cleaning solution holding surface 85, and the nozzle face 33 contacts to the cleaning solution held on the cleaning solution holding surface 85 when the head 32 passes. By this means, the cleaning solution is given to the nozzle face 33 of the head 32.

When the nozzle face 33 has passed above the cleaning solution holding surface 85, the supply of the cleaning solution is stopped.

The head 32 having passed above the cleaning solution giving nozzle 84 subsequently passes above the nozzle face wiping device 100.

When the tip of the head 32 (end part on the image recording position side) moves to a portion in front of the nozzle face wiping device 100, the supply shaft rotation drive motor 132, and the winding shaft rotation drive motor 134 and the feed roller rotation drive motor 136 are driven, and the wiping web 110 starts running. At this time, the wiping web 110 runs in a direction in which the wiping web 110 is wound around the winding shaft 116, and runs while tension T1 is applied.

When the head 32 passes above the nozzle face wiping device 100, the wiping web 110 is pressed and contacted to the nozzle face 33 of the head 32 through the pressure roller 118. By this means, the nozzle face 33 is wiped out.

When the nozzle face 33 has passed above the nozzle face wiping device 100, the running of the wiping web 110 is stopped.

The cleaning of the nozzle face 33 is completed by the above-mentioned series of processes.

Here, as mentioned above, the cleaning of the nozzle face 33 is performed by moving the head 32 from the maintenance position to the image recording position. Therefore, when the head 32 moves from the image recording position to the maintenance position, it is necessary to retract the pressure roller 118 such that the wiping web 110 does not contact to the nozzle face 33.

In a case where the pressure roller 118 is retracted, the control circuit 138 controls the drive of the supply shaft rotation drive motor 132, the winding shaft rotation drive motor 134 and the feed roller rotation drive motor 136, and applies tension T2 to the wiping web 110. For example, the rotation of the supply shaft 114 is stopped, the feed roller 124 and the winding shaft 116 are rotated by a predetermined amount, and tension T2 is applied to the wiping web 110. That is, by winding the wiping web 110 by the predetermined amount in a state where the feed of the wiping web 110 is stopped on the upstream side of the pressure roller 118, tension T2 is generated in the wiping web 110. By this means, the pressure roller 118 is depressed, and the head 32 can be moved from the image recording position to the maintenance position without contacting the wiping web 110 to the nozzle face 33.

Thus, according to the nozzle face wiping device 100 of the present embodiment, it is possible to switch the contact/separation of the wiping web 110 with respect to the nozzle face 33 by controlling the tension given to the wiping web 110. By this means, even if a large-scale mechanism is not installed, it is possible to switch the existence/non-existence of wiping.

Here, in the above-mentioned embodiment, a configuration is provided in which the cleaning of the nozzle face 33 is implemented only when the head 32 moves from the maintenance position to the image recording position, it is also possible to implement the cleaning of the nozzle face when the head 32 moves from the image recording position to the maintenance position. In this case, the cleaning of the nozzle face is performed without giving a cleaning solution. Here, in this case, a configuration is possible in which the wiping web 110 is pressed against the nozzle face 33 while the wiping web 110 is running, or it is possible to press the wiping web 110 against the nozzle face 33 without running the wiping web 110. In a case where the wiping web 110 is pressed against the nozzle face 33 without running, it is preferable to stop the rotation of the supply shaft 114. By this means, it is possible to prevent the wiping web 110 being drawn out.

[Second Embodiment]

Figure 9:
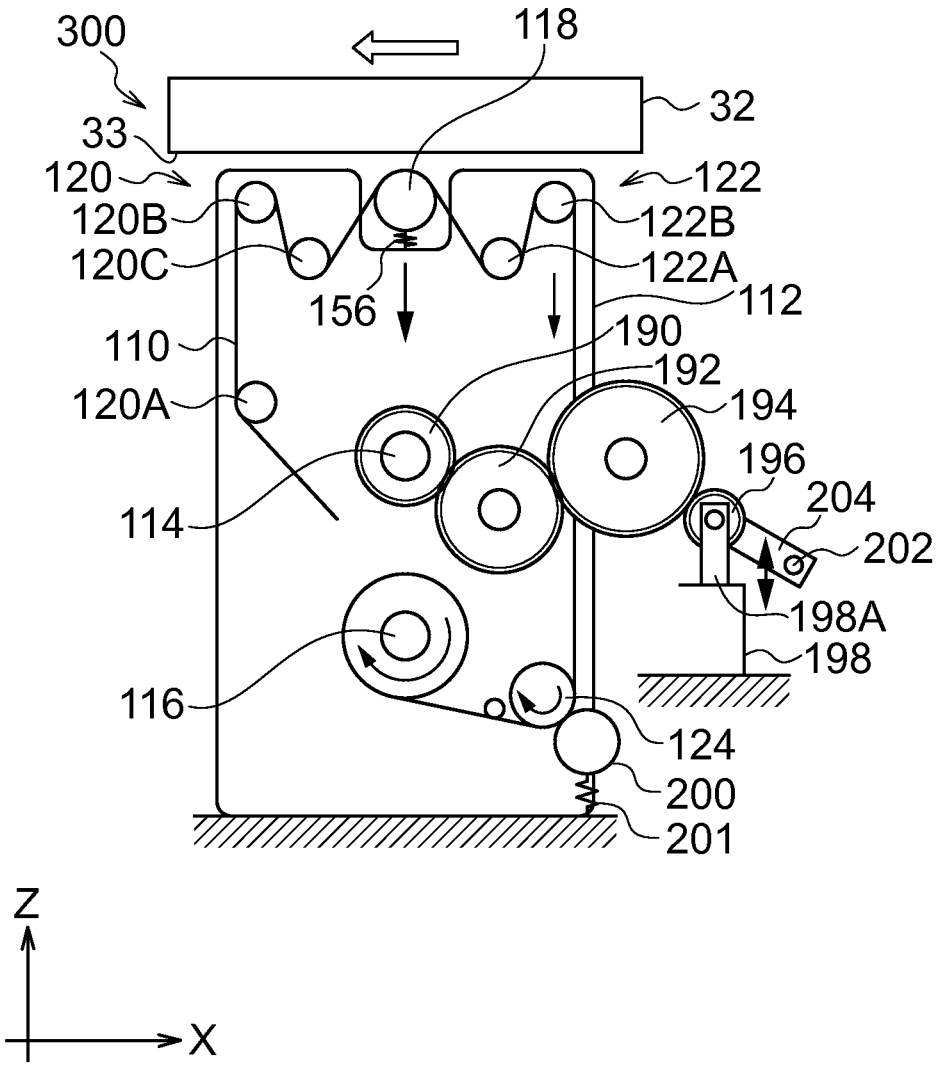
FIG. 9 is a front cross-sectional view illustrating a schematic configuration of the second embodiment of a nozzle face wiping device.

FIG. 9 is a schematic configuration diagram of the second embodiment of a nozzle face wiping device.

By locking the supply shaft 114, that is, by stopping the rotation of the supply shaft 114, a nozzle face wiping device 300 illustrated in the figure moves the pressure roller 118 downward in the figure. Since only the winding shaft 116 and the feed roller 124 are driven by stopping the rotation of the supply shaft 114, the running direction downstream side of the wiping web 110 is assumed to be pulled with respect to the pressure roller 118. Therefore, it is possible to give the tension to the wiping web 110 and move the pressure roller 118 downward.

As a method of locking the supply shaft 114, as illustrated in FIG. 9, it is possible to perform by fixing the supply shaft 114 by the use of multiple gears (gear sequence 188). Specifically, a first gear 190 is attached to the supply shaft 114. A second gear 192 included in the casing 112 is engaged with this first gear 190. Moreover, a third gear 194 (rotation gear (rotation member)) included in the casing 112 is engaged with this second gear 192. By engaging a fixed gear 196 (braking member) with the third gear 194 (rotation gear), the supply shaft 114 is locked.

The fixed gear 196 cannot be rotated, and can be moved up and down by a solenoid actuator 198 (which may be referred to as "solenoid" below) as a reciprocation drive device. A moving part 198A of the solenoid 198 is connected with the fixed gear 196. Moreover, the fixed gear 196 is held so as to be movable centering on a fulcrum 202 in a support member 204.

When the solenoid 198 is driven to extend the moving part 198A, the fixed gear 196 centering on the fulcrum 202 is pushed upward in the figure (FIG. 9). When the fixed gear 196 is pushed upward in the figure, the fixed gear 196 and the third gear 194 are engaged to fix the third gear 194. When the third gear 194 is fixed, the second gear 192 and the first gear 190 are further fixed to stop the rotation of the supply shaft 114.

If the drive of the solenoid 198 is stopped, since the moving part 198A is housed, the fixed gear 196 is moved downward in the figure and the engagement with the third gear is released, the first gear 190 becomes rotatable.

In the first embodiment, respective rollers of the supply shaft 114, the winding shaft 116 and the feed roller 124 are driven, but, in the second embodiment, a configuration is possible in which only the winding shaft 116 and the feed roller 124 are driven without driving the supply shaft 114 and the supply shaft 114 rotates according to the running of the wiping web 110.

Thus, by locking the supply shaft 114 and stopping the winding shaft 116 and the feed roller 124, it is possible to fix the wiping web 110 in a state where predetermined tension is given. Therefore, since a trouble such as the looseness of the wiping web 110 is not caused even if wiping is performed while the head 32 is moved in the same direction as the running direction of the wiping web 110, it is possible to wipe out the nozzle face 33 when the nozzle face 33 of the head 32 moves from the image recording position to the maintenance position in a direction opposite to the above-mentioned direction. As a case where wiping is performed at the time of movement from the image recording position to the maintenance position, there is a case, for example, where final wiping in the wiping of the nozzle face is performed.

Such wiping of the nozzle face 33 can be performed as final wiping after wiping is performed while relatively moving the head 32 and the wiping web 110 after a cleaning solution is given from the above-mentioned cleaning solution giving nozzle 84 to the nozzle face 33. Moreover in this case, when tension is applied too much, since the pressure roller 118 moves downward and does not contact to the nozzle face 33, it is necessary to arbitrarily adjust the force of the winding shaft 116 and the feed roller 124.

As described above, with a configuration in which tension is applied to the wiping web 110 and only the pressure roller 118 is moved up and down, since only the pressure roller can be assumed to be a moving part and the pressure roller 118 can be moved by small driving force, it is possible to miniaturize a drive actuator (such as a motor) of the feed roller.

Moreover, since the pressure roller 118 is only moved up and down and the head is not moved up and down. It is possible to maintain a stable state of a nozzle meniscus. In addition, since the head and the nozzle face wiping device are not moved up and down and a constant distance is kept, it is possible to prevent the head and a nozzle face cleaning layer from colliding and damaging at the time of malfunction. Since the pressure roller 118 is elastically supported and therefore the pressure roller 118 naturally sinks at the time of collision with the head, it is possible to reduce the risk that the head and the pressure roller 118 collide and are damaged.

Figure 10:
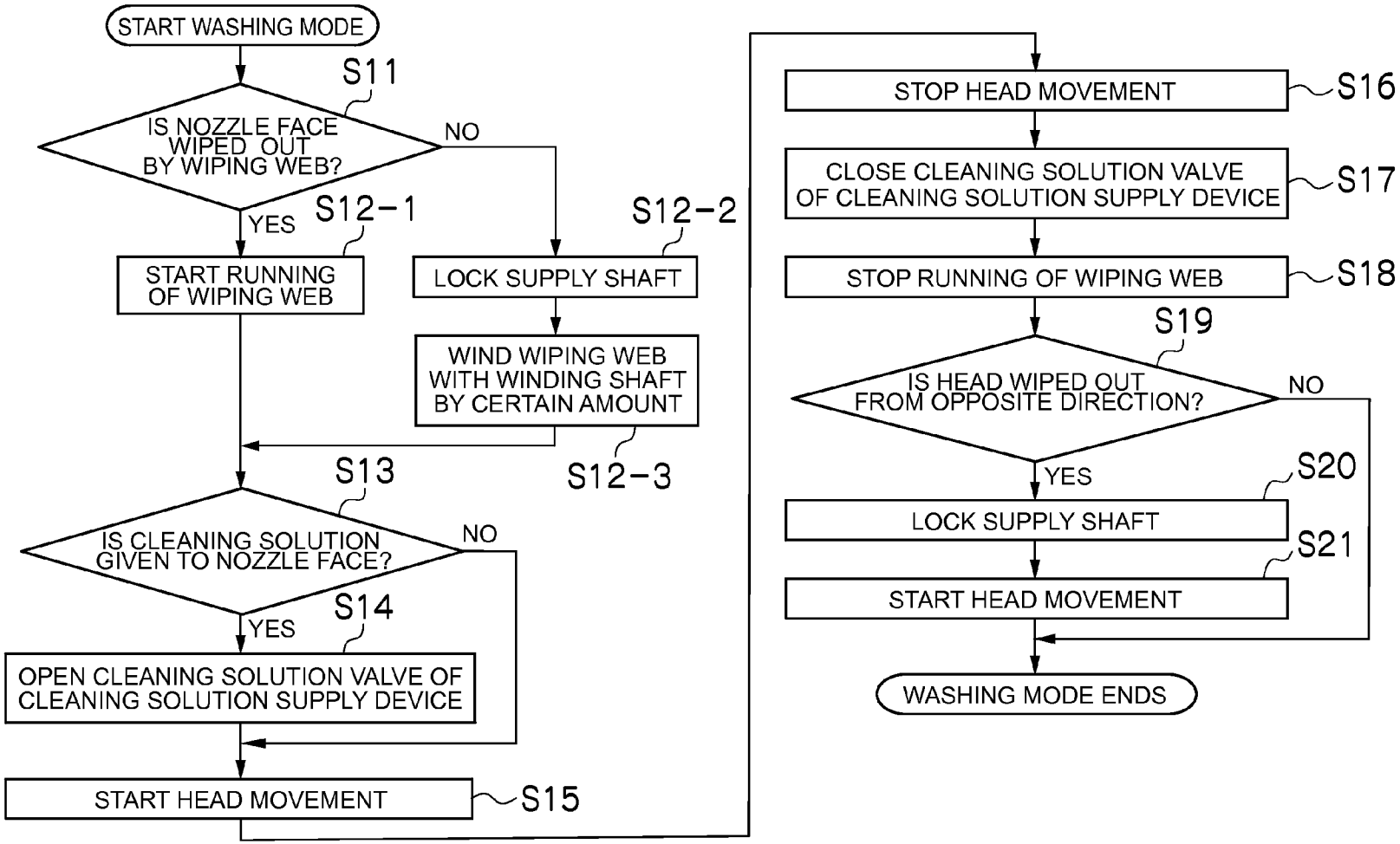
FIG. 10 is a flowchart illustrating the steps of a washing mode.

FIG. 10 is a flowchart illustrating the steps of a washing mode. When the washing mode starts, first, whether to wipe out the nozzle face 33 is determined (step S11). In a case where the nozzle face 33 is wiped out (determination Yes), the winding shaft 116 and the feed roller 124 are driven to start the transportation of the wiping web 110 (step S12-1).

In a case where the nozzle face 33 is not wiped out (determination No), the supply shaft 114 is locked (step S12-2), and the winding shaft 116 and the feed roller 124 are driven to wind the wiping web 110 in the winding shaft 116 by a constant amount (step S12-3). By winding the wiping web 110 in the winding shaft 116, it is possible to give tension to the wiping web 110 and move the pressure roller 118 downward (opposite side to the nozzle face of the head).

Next, whether to give a cleaning solution to the nozzle face is determined (step S13). In a case where the cleaning solution is given to the nozzle face, a cleaning solution valve (not illustrated) of a cleaning solution supply device is opened (step S14).

Next, the movement of the head 32 starts (step S15). As for the movement of the head 32, the cleaning of the nozzle face is performed at the time of movement from the maintenance position to the image recording position.

By the movement of the head, in a case where it is determined that the cleaning solution is given in step S13, the cleaning solution is sequentially given from the cleaning solution giving nozzle 84 to the nozzle face 33. Moreover, in a case where it is determined that wiping with the wiping web 110 is performed in step S11, the wiping web 110 is transported, and it is possible to always wipe out the nozzle face 33 by a new wiping web 110.

Moreover, in a case where it is determined that wiping is performed in step S11 (determination Yes) and the cleaning solution is not given in step S13 (determination No), the cleaning solution is not given to the nozzle face 33 and the nozzle face 33 is wiped out only by the wiping web 110.

In a case where it is determined that wiping is not performed in step S11 (determination No) and the cleaning solution is given in step S13 (determination Yes), the cleaning solution is only given to the nozzle face 33 by the cleaning solution giving nozzle 84. Moreover, in a case where it is determined that wiping is not performed in step S11 (determination No) and the cleaning solution is not given in step S13 (determination No), the cleaning of the nozzle face is not especially performed, and the head 32 is moved from the maintenance position to the image recording position.

When the cleaning of the nozzle face ends, the transportation of the head is stopped (step S16), the cleaning solution valve of the cleaning solution supply device is closed (step S17), and the transportation of the wiping web 110 is stopped (step S18).

Next, it is determined whether to perform wiping in a direction opposite to the movement direction of the head in step S15, that is, in the movement direction from the image recording position to the maintenance position (step S19). By wiping out the nozzle face at the time of movement from the image recording position to the maintenance position, it is possible to perform final wiping such as the removal of the remaining cleaning solution by the wiping operation performed in step S15.

In a case where it is determined that the head is wiped out from the opposite direction in step S19 (determination Yes), by locking the supply shaft 114 (step S20) and starting the movement of the head 32 (step S21), the nozzle face 33 is wiped out, and the washing mode ends after wiping. By wiping out the head while moving the head in the opposite direction in step S19, it can be performed as final wiping after the nozzle face is wiped out in steps S11 to S16.

Moreover, in a case where it is determined that the nozzle face is not wiped out in step S11 (determination No), by releasing the tension, returning the pressure roller 118 to a state where the tension is not given, and subsequently locking the supply shaft 114, it is possible to perform wiping from the opposite direction. In a state where it is determined that the head is not wiped out from the opposite direction (determination No), the washing mode ends.

Here, a configuration in which the supply shaft is locked has been described in FIG. 9, but steps S11 to S18 can also be implemented by using the running speed difference of the wiping web 110, giving tension to the wiping web 110 and moving the pressure roller downward.

Moreover, the head has a structure in which the head modules illustrated in FIG. 4 are joined along the longitudinal direction (movement direction of the image recording position and the maintenance position of the head). As for the washing of the nozzle face of the head, it is also possible to implement the washing with respect to all modules or determine whether to implement washing every module.

[Third Embodiment]

<<Device Configuration>>

Figure 11:
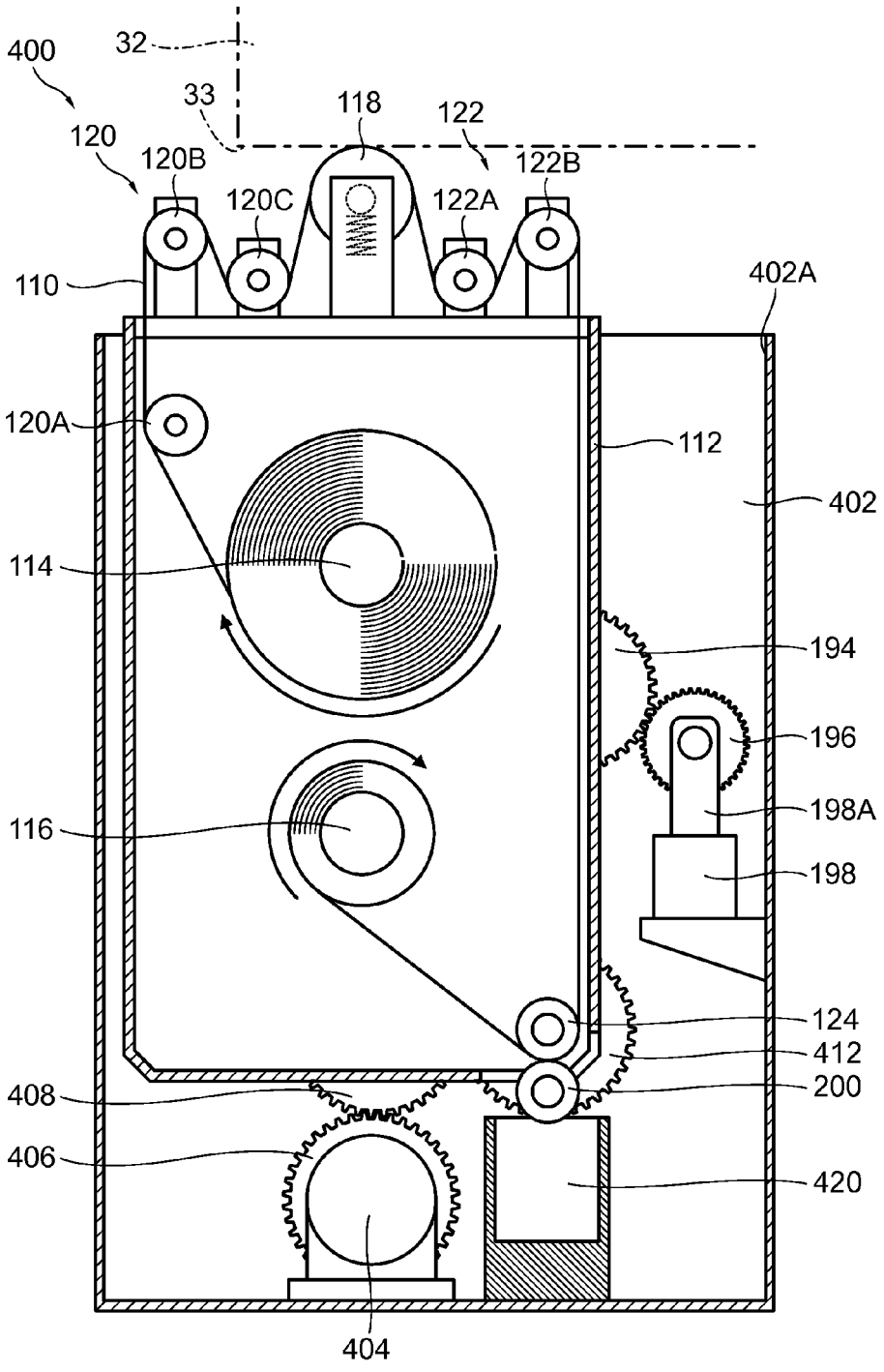
FIG. 11 is a front cross-sectional view illustrating a schematic configuration of the third embodiment of a nozzle face wiping device.
Figure 12:
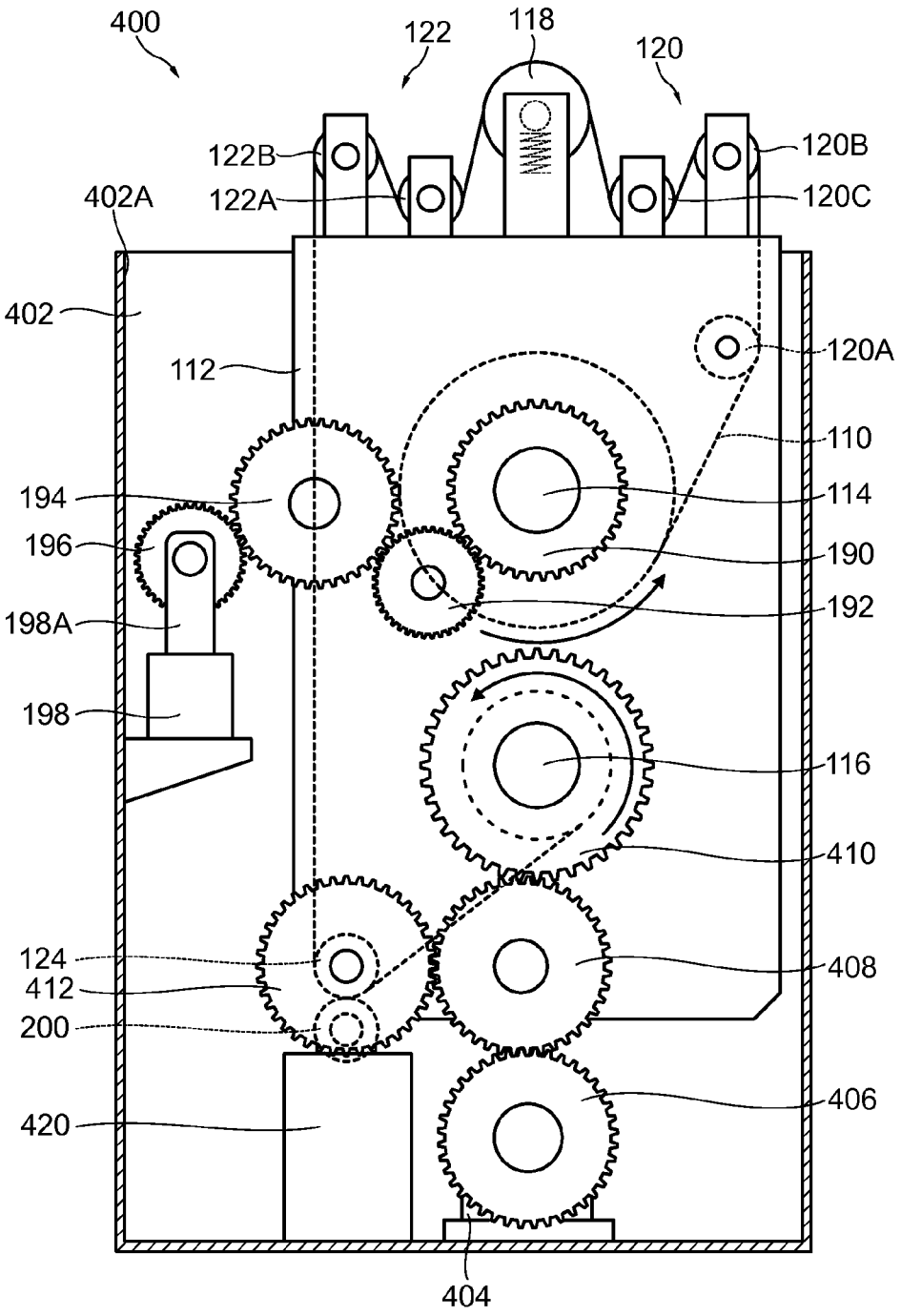
FIG. 12 is a rear view illustrating a schematic configuration of the third embodiment of a nozzle face wiping device.
Figure 13:
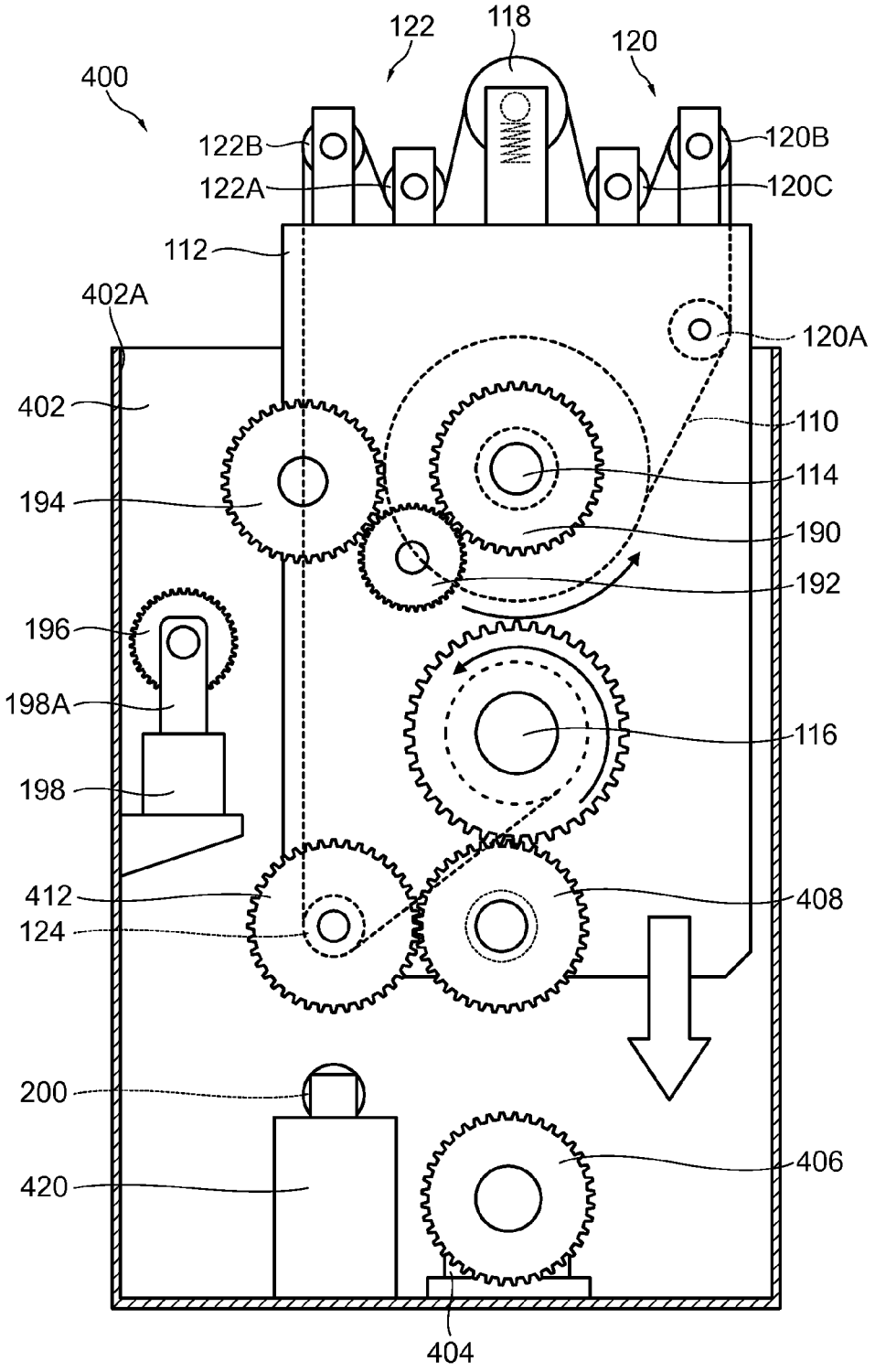
FIG. 13 is an operation explanatory diagram of a nozzle face wiping device of the third embodiment.
Figure 14:
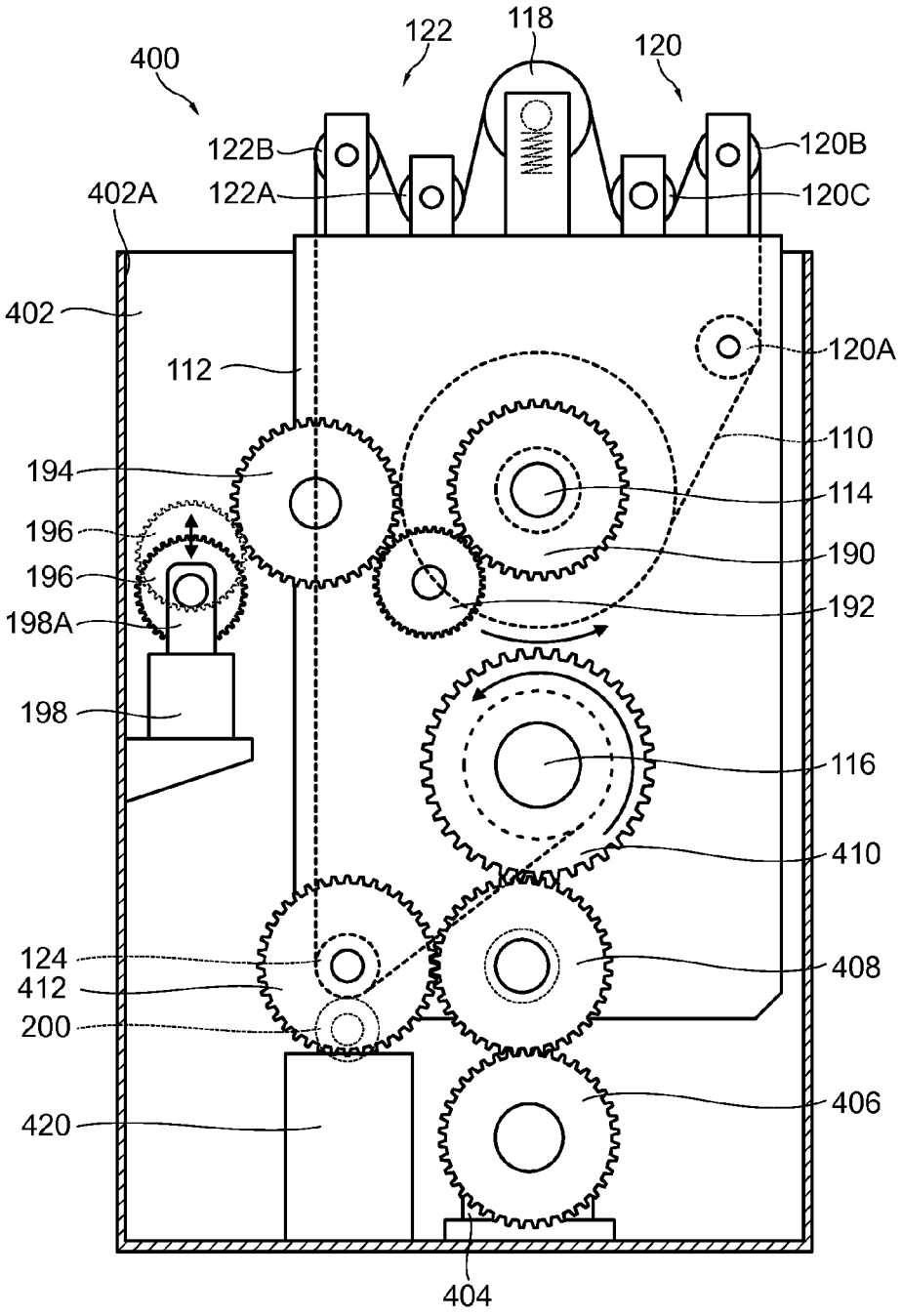
FIG. 14 is an operation explanatory diagram of a nozzle face wiping device of the third embodiment.

FIGS. 11 and 12 are the front cross-sectional view and rear view illustrating the schematic configuration of the third embodiment of a nozzle face wiping device. FIGS. 13 and 14 are operation explanatory diagrams of nozzle face wiping device of the third embodiment.

In a nozzle face wiping device 400 of the present embodiment, the casing 112 housing the wiping web 110 is detachably installed in a device body 402. In the device body 402, a drive source of the running of the wiping web 110 and a braking device which brakes the running of the wiping web 110 are included, and, when the casing 112 is attached to the device body 402, the drive and braking of the wiping web 110 become possible.

Moreover, the nozzle face wiping device 400 of the present embodiment is configured to rotate and drive the winding shaft 116 and the feed roller 124 and run the wiping web 110 (the supply shaft 114 is configured not to be rotated and driven).

In addition, the nozzle face wiping device 400 of the present embodiment is assumed to be configured to brake the rotation of the supply shaft 114, give tension to the wiping web 110 and stop the running of the wiping web 110.

Here, regarding members having the same function as the nozzle face wiping devices 100 and 300 of the first and second embodiments mentioned above, the same reference numerals are assigned and the explanation is omitted.

The casing 112 has a box shape and houses the wiping web 110 therein. The casing 112 has a lid (not illustrated) in the front part. The wiping web 110 opens this lid and is loaded in the casing 112.

The device body 402 has a housing portion 402A that houses the casing 112. The casing 112 is housed in this housing portion 402A and attached to the device body 402. The housing portion 402A has an opening in the upper part. As illustrated in FIG. 13, the casing 112 is housed in the housing portion 402A by being vertically inserted in this opening. The housing portion 402A includes a positioning member which is not illustrated. When the casing 112 is inserted in the opening, the casing 112 is positioned in a predetermined position by this positioning member and housed in the housing portion 402A (for example, the casing 112 is positioned in the predetermined position when the positioning member contacts to the outer periphery of the casing 112).

As mentioned above, in the nozzle face wiping device 400 of the present embodiment, the drive source and a braking device for the wiping web 110 are included in the device body 402. Therefore, the casing 112 includes only mechanisms to guide the running of the wiping web 110, such as the supply shaft 114, the winding shaft 116, the pressure roller 118, the previous-stage guide portion 120, the subsequent-stage guide portion 122 and the feed roller 124.

The drive source of the running of the wiping web 110 (a drive source of the wiping web running drive device) includes a motor 404, and rotates and drives the winding shaft 116 and the feed roller 124 with this the motor 404. That is, in the nozzle face wiping device 400 of the present embodiment, the wiping web running drive device includes the motor 404, the winding shaft 116 and the feed roller 124.

Moreover, the braking device of the wiping web 110 includes the fixed gear (braking member) 196 as a braking member and the solenoid (solenoid actuator) 198 for the engagement/disengagement of the fixed gear 196.

The motor 404 is disposed in the housing portion 402A. The motor 404 includes a driving gear 406 in the output axis. This driving gear 406 rotates when the motor 404 is driven.

The casing 112 includes a driven gear 408 that engages with the driving gear 406. When the casing 112 is attached to the device body 402, the driven gear 408 engages with the driving gear 406.

The winding shaft 116 includes a winding gear 410 that engages with the driven gear 408. Moreover, the feed roller 124 includes a feed gear 412 that engages with the driven gear 408. When the driven gear 408 is rotated, the winding shaft 116 and the feed gear 412 rotate at the same time.

When the casing 112 is attached to the device body 402, the driven gear 408 engages with the driving gear 406. When the driving gear 406 is rotated by the motor 404, the rotation is transmitted to the driven gear 408. Further, when this driven gear 408 rotates, the winding gear 410 and the feed gear 412 rotate at the same time, and the winding shaft 116 and the feed gear 412 rotate at the same time.

The drive of the motor 404 is controlled by a control circuit (not illustrated) as a running control device.

As mentioned above, the nozzle face wiping device 400 of the present embodiment rotates and drives the winding shaft 116 and the feed roller 124 to run the wiping web 110. Therefore, the supply shaft 114 is merely supported in a rotatable manner, and the drive device is not included.

The supply shaft 114 is rotatably supported by the casing 112, but, if the rotational resistance is too low, the wiping web 110 is drawn out more than necessity when the wiping web 110 is wound, and looseness or the like is caused in the wiping web 110. Therefore, in the supply shaft 114, a constant load is applied to the rotation by a friction mechanism (not illustrated). In the friction mechanism, for example, a friction member is pressed and contacted to the supply shaft 114 to give constant resistance to the rotation of the supply shaft 114. By this means, unless the wiping web 110 is wound with constant tension or more, the wiping web 110 cannot be drawn out from the supply shaft 114, and the occurrence of looseness or the like is prevented.

The solenoid 198 as a reciprocation drive device is disposed in the housing portion 402A. The solenoid 198 includes the moving part 198A that reciprocates. In the solenoid 198, the moving part 198A projects at the time of ON (energization), and the moving part 198A is retracted at the time of OFF (energization stop).

The fixed gear 196 as a braking member is attached to the moving part 198A of the solenoid 198 in an unrotatable manner. The fixed gear 196 projects and moves to the "engagement position" when the solenoid 198 is turned on (see FIG. 12), and is retracted and moves to the "disengagement position" when the solenoid 198 is turned off (see FIG. 14).

The drive (ON/OFF by energization) of the solenoid 198 is controlled by a control circuit (not illustrated) as a running control device.

The rotation of the supply shaft 114 is braked (locked) when the fixed gear 196 engages with the gear sequence 188 included in the casing 112.

The gear sequence 188 includes a first gear 190, a second gear 192 and a third gear 194, and rotates in synchronization with the rotation of the supply shaft 114. The first gear 190 is attached to the supply shaft 114. The second gear 192 is rotatably installed in the casing 112. The second gear 192 is engaged with the first gear 190. The third gear (rotation member) 194 is rotatably installed in the casing 112. The third gear 194 is engaged with the second gear 192.

The fixed gear 196 is engaged with the third gear 194. When the fixed gear 196 is engaged with the third gear 194, the third gear 194 is locked in an unrotatable manner. Further, when the third gear 194 is locked in an unrotatable manner, the second gear 192 and the first gear 190 are locked in an unrotatable manner at the same time, and the supply shaft 114 is locked in an unrotatable manner.

As illustrated in FIG. 12, when the casing 112 is attached to the device body 402, the third gear 194 included in the casing 112 is disposed in a predetermined position on the device body 402.

As mentioned above, the fixed gear 196 is driven by the solenoid 198 and reciprocates between the "engagement position" and the "disengagement position". As illustrated in FIG. 12, when the fixed gear 196 is moved to the engagement position in a state where the casing 112 is attached to the device body 402, the fixed gear 196 engages with the third gear 194 positioned in the predetermined position on the device body 402. Moreover, as illustrated in FIG. 14, when the fixed gear 196 is moved to the disengagement position in a state where the casing 112 is attached to the device body 402, the engagement of the third gear 194 positioned in the predetermined position on the device body 402 and the fixed gear 196 is released.

That is, when the solenoid 198 is turned on in a state where the casing 112 is attached to the device body 402, it is possible to lock the supply shaft 114 in an unrotatable manner, and, when the solenoid 198 is turned off, it is possible to release the lock.

The device body 402 further includes the nip roller 200 and a waste liquid receiver 420.

When the casing 112 is attached to the device body 402, the nip roller 200 is contacted to the feed roller 124 included in the casing 112. The nip roller 200 is biased by a spring (not illustrated) toward the feed roller 124 so as to contact to the feed roller 124 with predetermined pressure force.

When the waste liquid receiver 420 is nipped by the nip roller 200 and the feed roller 124, the waste liquid receiver 420 collects a liquid removed from the wiping web 110. The nip roller 200 is disposed in this waste liquid receiver 420.

<<Operation>>

<Basic Operation>

As mentioned above, in the nozzle face wiping device 400 of the present embodiment, the casing 112 that houses the wiping web 110 is detachably installed in the device body 402.

As illustrated in FIGS. 12 and 13, when the casing 112 is inserted in the housing portion 402A of the device body 402, the casing 112 is positioned in the device body 402 and attached.

When the casing 112 is attached to the device body 402, the driving gear 406 is engaged with the driven gear 408 included in the casing 112. By this means, the rotation drive of the winding shaft 116 and the feed roller 124 becomes possible.

Moreover, the nip roller 200 is pressed and contacted to the feed roller 124 included in the casing 112, and the wiping web 110 wound around the feed roller 124 is nipped by the nip roller 200.

Moreover, when the casing 112 is attached to the device body 402, the braking of the supply shaft 114 becomes possible. That is, it is possible to lock the supply shaft 114 that operates the solenoid 198 (turns on the solenoid 198), in an unrotatable manner.

<Contact/separation Operation>

As mentioned above, by controlling the tension of the wiping web 110 wound around the pressure roller 118, it is possible to control the contact/separation of the pressure roller 118 with respect to the nozzle face 33.

At the time of separation, stronger tension than that at the time of contact is given to the wiping web 110. Specifically, first, the supply shaft 114 is locked. Next, the winding shaft 116 and the feed roller 124 are rotated and driven, and the wiping web 110 is wound around the winding shaft 116 by a constant amount. By this means, strong tension is applied to the wiping web 110, and the pressure roller 118 is depressed against the biasing force of the spring.

The supply shaft 114 is locked by turning on the solenoid 198. When the solenoid 198 is turned on, as illustrated in FIG. 13, the fixed gear 196 moves to the engagement position and is engaged with the third gear 194. By this means, the supply shaft 114 is locked in an unrotatable manner.

The winding shaft 116 and the feed roller 124 are rotated and driven at the same time by driving the motor 404.

Thus, to prevent the pressure roller 118 from contacting to the nozzle face 33, the wiping web 110 is wound by a predetermined amount in a state where the supply shaft 114 is locked. By this means, the pressure roller 118 is depressed by the tension of the wiping web 110 and retracted to a position in which the pressure roller 118 does not contact to the nozzle face 33.

In a case where the pressure roller 118 is contacted to the nozzle face 33 again, the lock of the supply shaft 114 is released. That is, the solenoid 198 is turned off. When the solenoid 198 is turned off, the fixed gear 196 moves to the disengagement position, and the engagement of the fixed gear 196 and the third gear 194 is released. By this means, the supply shaft 114 is rotatably supported, and the tension applied to the wiping web 110 is released. Further, when this tension is released, the pressure roller 118 is pushed up by the force of the spring and moved to a position in which the pressure roller 118 can contact to the nozzle face 33.

Thus, by controlling the lock/unlock of the supply shaft 114 and controlling the winding of the wiping web 110, it is possible to control the contact/separation of the pressure roller 118 with respect to the nozzle face 33. By this means, it is possible to switch the existence/non-existence of wiping when the head 32 is moved.

<Wiping>

The pressure roller 118 is rotatably supported in the nozzle face wiping device 400 of the present embodiment, but, since the running of the wiping web 110 can be braked on the upstream side of the pressure roller 118, it is possible to wipe out the nozzle face 33 even in a case where the head 32 is moved in any direction.

That is, for example, in a case where the braking device of the wiping web 110 is not included like the nozzle face wiping device 400 of the present embodiment, when the running direction of the wiping web 110 wound around the pressure roller 118 is the same as the movement direction of the head 32, the wiping web 110 is forcefully drawn out from the supply shaft 114, and looseness or the like is caused in the wiping web 110.

However, if the wiping web 110 is stopped on the upstream side of the pressure roller 118, even in a case where the running direction of the wiping web 110 is the same as the movement direction of the head 32, it is possible to prevent the wiping web 110 from being drawn out from the supply shaft 114.

In the nozzle face wiping device 400 of the present embodiment, when the wiping web 110 is wound by the winding shaft 116, the wiping web 110 wound around the pressure roller 118 runs in the same direction as the movement direction of the head 32 that moves from the image recording position to the maintenance position. Therefore, when the head 32 moves from the image recording position to the maintenance position, the rotation of the supply shaft 114 is locked. By this means, it is possible to prevent the wiping web 110 from being forcefully drawn out from the supply shaft 114. Here, at this time, when the winding shaft 116 and the feed roller 124 are rotated and driven, since tension is applied to the wiping web 110 and the pressure roller 118 is depressed, the wiping web 110 is pressed and contacted to the nozzle face 33 without rotating and driving the winding shaft 116 and the feed roller 124.

In the following, an explanation is given of wiping operation in a case where the head 32 moves from the maintenance position to the image recording position and a case where the head 32 moves from the image recording position to the maintenance position.

[Maintenance Position->Image Recording Position]

When the head 32 moves from the maintenance position to the image recording position, the wiping web 110 is pressed and contacted to the nozzle face 33 while running the wiping web 110.

In this case, the solenoid 198 is turned off to drive the motor 404. When the motor 404 is driven, the winding shaft 116 and the feed roller 124 are rotated and driven, and the wiping web 110 is wound around the winding shaft 116. By this means, the wiping web wound around the pressure roller 118 runs in a direction from the image recording position to the maintenance position. This direction is a direction opposite to the movement direction of the head 32.

As for the head 32, the wiping web 110 running in this opposite direction is pressed against the nozzle face 33, and the nozzle face 33 is wiped out.

[Image Recording Position->Maintenance Position]

When the head 32 moves from the image recording position to the maintenance position, the rotation of the supply shaft 114 is locked, and the wiping web 110 is pressed and contacted to the nozzle face 33. At this time, the motor 404 is not driven. The stopped wiping web 110 is pressed and contacted to the nozzle face 33, but, since the rotation of the supply shaft 114 is locked, the wiping web 110 is not drawn out from the supply shaft 114.

Thus, according to the nozzle face wiping device 400 of the present embodiment, it is possible to wipe out the nozzle face 33 when the head 32 moves from the maintenance position to the image recording position and when the head 32 moves from the image recording position to the maintenance position. Further, by wiping out the nozzle face 33 from two directions in this way, it is possible to effectively remove a foreign body attached to the inside (inner edge) of the ejection port of nozzle N. That is, when wiping is performed in only one direction, there occurs a problem that the foreign body is gradually piled on the upstream side of the wiping direction (downstream side of the movement direction of the head 32), but such a problem can be solved by performing wiping in both directions.

Here, when wiping at the time the head 32 moves from the maintenance position to the image recording position is assumed to be "forward wiping" and wiping at the time the head 32 moves from the image recording position to the maintenance position is assumed to be "backward wiping", a combination thereof can be arbitrarily set. That is, only the forward wiping may be implemented or only the backward wiping may be implemented. Moreover, a combination of the forward wiping and the backward wiping may be implemented multiple times, or the backward wiping may be implemented at last after the forward wiping is implemented multiple times.

In general, since the forward wiping in which the running direction of the wiping web 110 is opposite has a higher cleaning ability than the backward wiping that the wiping web 110 is wiped in a state where the wiping web 110 is stopped, the forward wiping and the backward wiping may be switched according to the level of dirt on the nozzle face 33.

For example, it is also possible to use the forward wiping with high wiping performance (large used web amount) when there is much dirt on the nozzle face 33 (when there are many printed sheets), and use the backward wiping when there is little dirt on the nozzle face 33.

Moreover, when the ejection performance of the head 32 deteriorates, round-trip wiping including the backward wiping may be performed multiple times.

Moreover, the forward wiping and the backward wiping may be alternately implemented.

[Alternation Example of Third Embodiment]

In the above-mentioned embodiment, a configuration is provided in which the winding shaft 116 and the feed roller 124 are rotated and driven to wind the wiping web 110 around the winding shaft 116, but it is also possible to provide a configuration in which only the winding shaft 116 is rotated and driven.

Moreover, it is possible to omit the feed roller 124 and the nip roller 200 from the configuration of the nozzle face wiping device. In this case, only the winding shaft 116 is rotated and driven.

Figure 15:
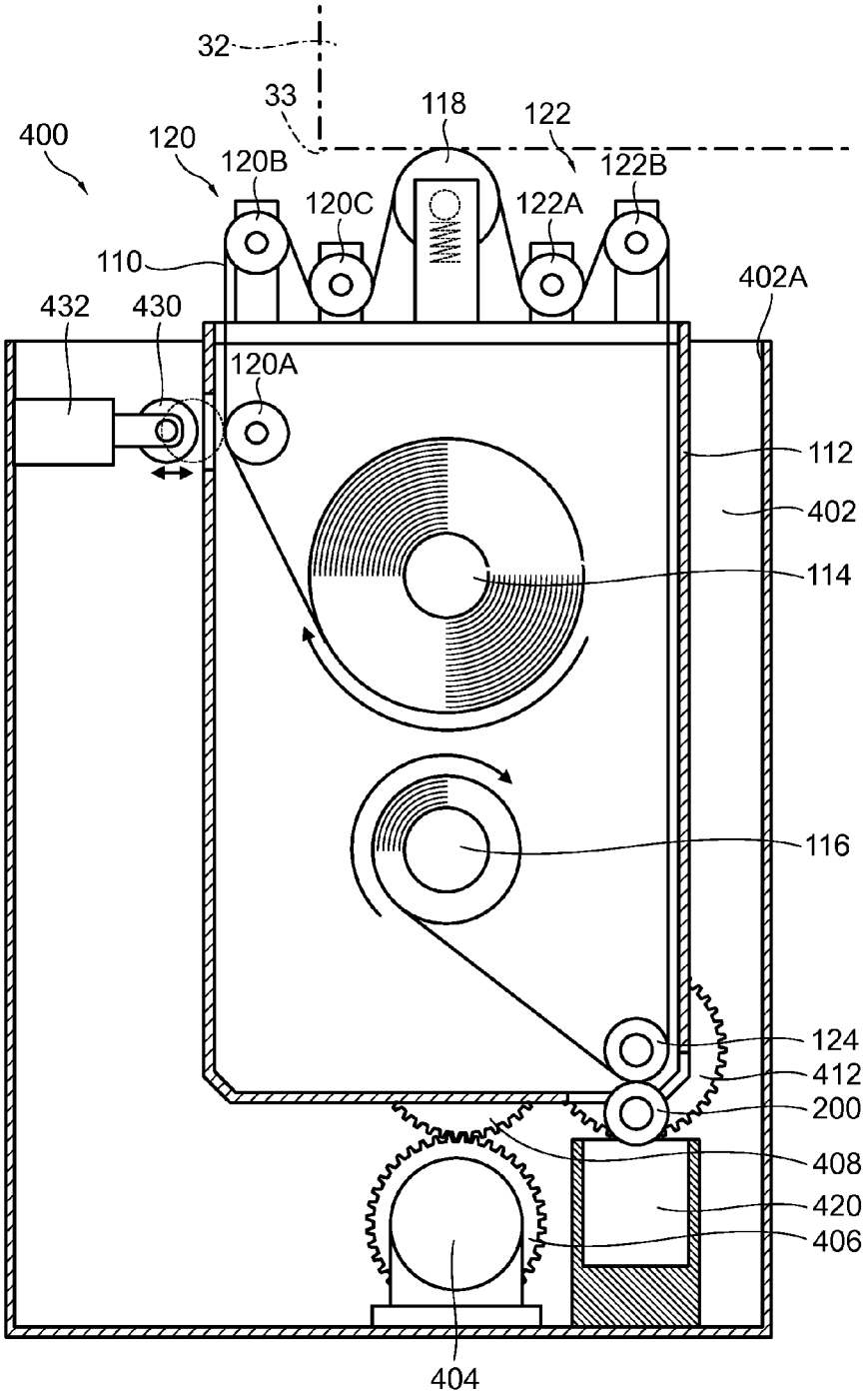
FIG. 15 is a front cross-sectional view illustrating an alternation example of a nozzle face wiping device of the third embodiment.

Moreover, in the above-mentioned embodiment, a configuration is provided in which the running of the wiping web 110 is braked on the upstream side of the pressure roller 118 by braking the rotation of the supply shaft 114, but means for braking the running of the wiping web 110 is not limited to this. For example, as illustrated in FIG. 15, a configuration is also possible in which the wiping web 110 is strongly nipped with the guide roller 120A that guides the wiping web 110 drawn out from the supply shaft 114 and the running of the wiping web 110 is stopped. In the example illustrated in the figure, a braking roller 430 that nips and brakes the wiping web 110 with the guide roller 120A is included in the device body 402, and a configuration is provided in which the braking roller 430 is reciprocated toward the guide roller 120A by a solenoid actuator 432. When the solenoid actuator 432 is turned on, the braking roller 430 is pressed and contacted to the guide roller 120A to nip the wiping web 110 wound around the guide roller 120A. Moreover, when the solenoid actuator 432 is turned off, it is separated from the guide roller 120A to release the lock of the wiping web 110.

Besides this, a configuration is also possible in which a friction member (member of much friction such as a rubber) is pressed and contacted to the supply shaft 114 (or a rotation member (such as a rotating disk) attached to the supply shaft 114) and the rotation of the supply shaft 114 is braked.

[Other Embodiments]

Like the nozzle face wiping device of each embodiment mentioned above, the nozzle face wiping device configured to wind the wiping web 110 from the supply shaft 114 to the winding shaft 116 can detect a running trouble of the wiping web 110 by monitoring the rotation of the supply shaft 114. That is, since the supply shaft 114 is always rotated when the wiping web 110 is run, a case where the supply shaft 114 does not rotate through the wiping web running drive device is driven can be determined as a trouble. Moreover, a case where the supply shaft 114 rotates though the wiping web running drive device is not driven can be also determined as a trouble.

Figure 16:
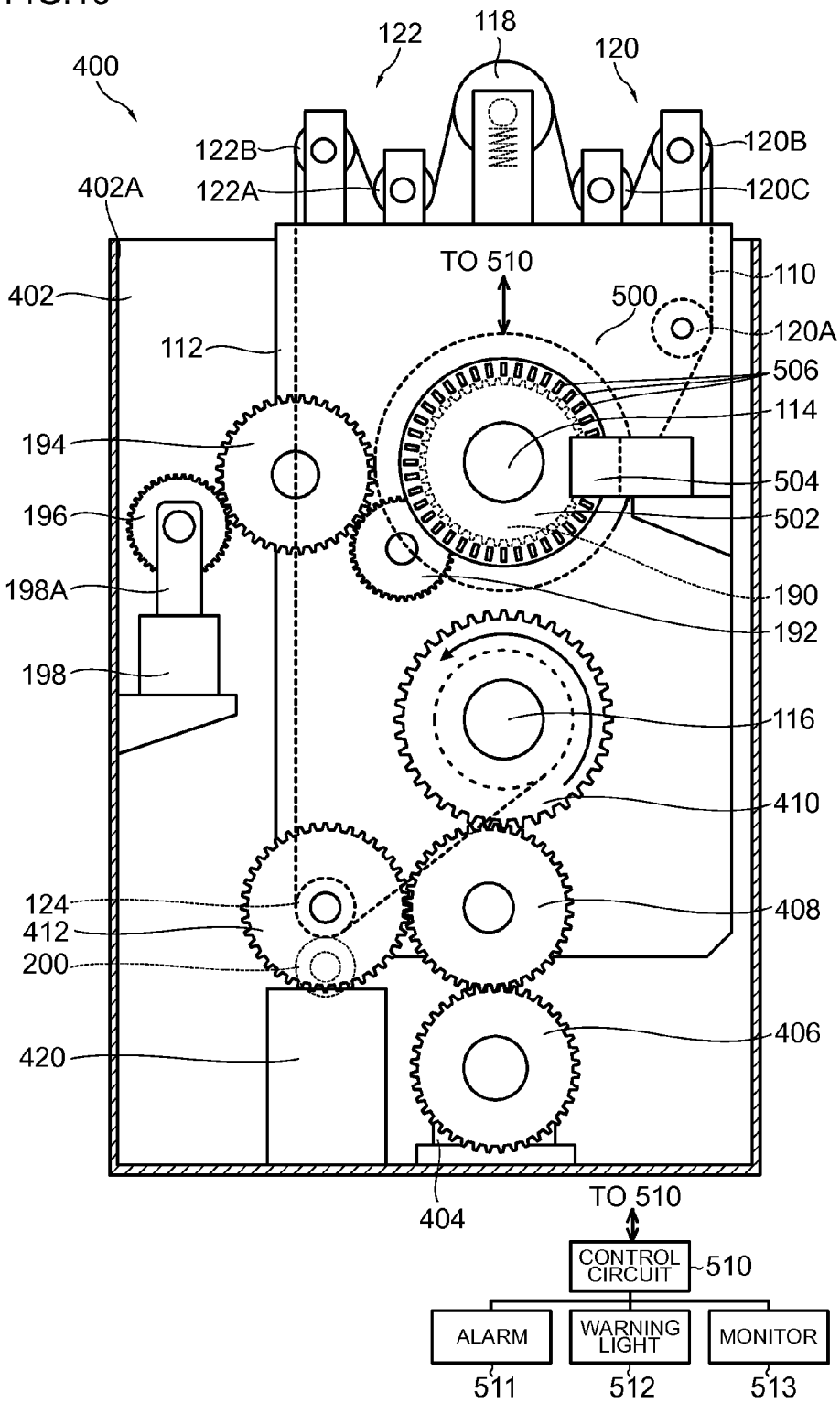
FIG. 16 is a rear view illustrating a schematic configuration of a nozzle face wiping device including a rotation detection function of a supply shaft.

FIG. 16 is a rear view illustrating the schematic configuration of a nozzle face wiping device having a rotation detection function of the supply shaft.

Here, it is the same as the nozzle face wiping device 400 of the third embodiment mentioned above, except for that it has the rotation detection function of the supply shaft.

In this example, as a rotation detection device, a configuration is provided in which the rotation of the supply shaft 114 is detected by a rotary encoder 500.

The rotary encoder 500 mainly includes a rotating disk 502 and a detector 504.

The rotating disk 502 has a slit 506 in the outer periphery at regular intervals. The rotating disk 502 is attached to the supply shaft 114.

The detector 504 is included in the device body 402. The detector 504 includes a light projection portion (not illustrated) and a light receiving portion (light receiving portion) that receives the light projected from the light projection portion. The light projection portion and the light receiving portion are disposed at a constant interval so as to face to each other. When the casing 112 is attached to the device body 402, the rotating disk 502 is disposed between this light projection portion and the light receiving portion.

The rotating disk 502 rotates when the supply shaft 114 rotates. When the rotating disk 502 rotates, the light path of the light projected from the light projection portion is interrupted every one pitch of the slit, and the light and shade of the frequency proportional to the amount of rotation is repeated. The detector 504 extracts this light and shade as an electrical signal in the light receiving portion, performs waveform shaping and outputs the result as a rectangular wave.

A control circuit 510 detects a running trouble of the wiping web 110 on the basis of the output from the rotary encoder 500.

That is, for example, during operation, in a case where the supply shaft 114 does not rotate though a drive signal is output to the motor 404, since it is possible to determine that the wiping web 110 does not run, a running trouble of the wiping web 110 is determined.

On the other hand, for example, during a drive stop, in a case where the supply shaft 114 rotates though the drive signal is not output to the motor 404 and a case where the supply shaft 114 rotates though the solenoid 198 is operated (ON), since it is possible to determine that the wiping web 110 runs, the running trouble of the wiping web 110 is determined.

Thus, by monitoring the rotation of the supply shaft 114, it is possible to detect the running trouble of the wiping web 110.

Here, in a case where the running trouble of the wiping web 110 is detected, it is preferable to perform warning processing. As the warning processing, for example, processing of sounding an alarm when the alarm (reference numeral 511 in FIG. 13) is included as a warning device, processing of lighting warning light in a case where the warning light (reference numeral 512 in FIG. 13) is included as a warning device, and processing of displaying an alert message on a monitor when the monitor (reference numeral 513 in FIG. 13) is included as a warning device, and, so on, are performed.

In the nozzle face wiping device of each embodiment mentioned above, a configuration is provided in which the nozzle face wiping device is fixed and the nozzle face is wiped out by moving the head side, but a configuration is also possible in which the head is fixed and the nozzle face is wiped out by moving the nozzle face wiping device side along the nozzle face. Moreover, a configuration is also possible in which the nozzle face is wiped out by moving both the nozzle face wiping device and the head. That is, it only has to provide a configuration in which the head and the nozzle face wiping device can be relatively moved.

Moreover, by including a wiping web braking device, the nozzle face wiping device of each embodiment mentioned above realizes a function that contacts/separates the wiping web to/from the nozzle face and a function that enables wiping from two directions, but it is also possible to realize only one of the functions. That is, the wiping web braking device may be used only to contact/separate the wiping web to/from the nozzle face, or the wiping web braking device may be used only to enable wiping from two directions.

In a case where the wiping web braking device is used only to enable wiping from two directions, it is necessary to additionally provide means for contacting/separating the wiping web to/from the nozzle face. In this case, the head may be reciprocated (vertical movement in the nozzle face wiping device of the above-mentioned embodiments) to contact/separate the wiping web to/from the nozzle face, or the entire nozzle face wiping device may be reciprocated (vertical movement in the nozzle face wiping device of the above-mentioned embodiments) to contact/separate the wiping web to/from the nozzle face. Moreover, a pressure member may be reciprocated (vertical movement in the nozzle face wiping device of the above-mentioned embodiments) to contact/separate the wiping web to/from the nozzle face.

Moreover, the nozzle face wiping device of the above-mentioned embodiments is configured to wipe out the nozzle face by a wiping web in a dry state (so-called, dry wipe), but a configuration is also possible in which the nozzle face is wiped out by a wiping web in a state where a cleaning solution is contained (so-called, wet wipe). In this case, a cleaning solution supply device is disposed on the upstream side (supply shaft side) of the pressure roller, the cleaning solution is given to the wiping web before being wound around the pressure roller, and the wiping web is wetted.

Moreover, the nozzle face wiping device of the above-mentioned embodiments is configured to press and contact the wiping web to the nozzle face by the pressure roller, but the form of the pressure member to press and contact the wiping web to the nozzle face is not limited to this. For example, a configuration is also possible in which the wiping web is pressed and contacted to the nozzle face by a pressure member having an arc-shaped guide surface.

What is claimed is:

1. A nozzle face wiping device that relatively moves along a nozzle face of an ejection head and wipes out the nozzle face, the nozzle face wiping device comprising:

a rotatable supply shaft;

a wiping web that is wound in a roll manner and attached to the supply shaft;

a winding shaft;

a wiping web running drive device which winds the wiping web around the winding shaft and running the wiping web;

a pressure member that presses and contacts the wiping web to the nozzle face while being wound by the wiping web that runs between the supply shaft and the winding shaft;

a braking device which brakes running of the wiping web on an upstream side of the pressure member with respect to a running direction of the wiping web;

a rotation detection device which detects the rotation of the supply shaft;

a wiping web running trouble detection device which detects a running trouble of the wiping web in accordance with a detection result of the rotation detection device, wherein when the rotation of the supply shaft is detected by the rotation detection device while drive of the winding shaft by the wiping web running drive device stops, the wiping web running trouble detection device determines that the running trouble of the wiping web exists; and a warning device which generates warning when the running trouble of the wiping web is detected by the wiping web running trouble detection device.

2. The nozzle face wiping device according to claim 1, further comprising:

a running control device which controls the wiping web running drive device and the braking device and controlling the naming of the wiping web at wiping, operating the wiping web running drive device without operating the braking device when the running direction of the wiping web wound around the pressure member is opposite to a movement direction of the nozzle face, and operating the braking device without operating the wiping web running drive device when the running direction of the wiping web wound around the pressure member is identical to the movement direction of the nozzle face.

3. The nozzle face wiping device according to claim 1, further comprising:

a pressure member support device which supports the pressure member to the nozzle face in a reciprocable manner;

a biasing device which biases the pressure member to the nozzle face; and a tension giving device which gives tension to the wiping web and evacuating the pressure member from the nozzle face by controlling the wiping web running drive device and the braking device, and giving the tension to the wiping web by operating the wiping web running drive device in a state where the braking device is operated.

4. The nozzle face wiping device according to claim 1, wherein the braking device brakes rotation of the supply shaft and brakes the running of the wiping web.

5. The nozzle face wiping device according to claim 4, further comprising a rotation member that rotates in synchronization with the supply shaft, wherein the braking device includes:

a braking member that contacts to the rotation member and brakes rotation of the rotation member; and a reciprocation drive device which reciprocates the braking member with respect to the rotation member and contacting/separating the braking member to/from the rotation member.

6. The nozzle face wiping device according to claim 5, wherein:

the rotation member is a rotation gear that rotates in synchronization with the supply shaft;

the braking member is a fixed gear that cannot rotate; and the fixed gear is engaged with or disengaged from the rotation gear by the reciprocation drive device.

7. The nozzle face wiping device according to claim 5, farther comprising:

a casing that includes the supply shaft, the wiping web, the winding shaft, the pressure member and the rotation member; and a device body including a drive source of the wiping web running drive device and the braking device, to which the casing is detachably attached.

8. An image recording device comprising:

a transportation portion that transports a recording medium;

an ejection head that ejects an is drop to the recording medium transported by the transportation portion and forms an image; and a nozzle face wiping device according to claim 1 that cleans a nozzle face of the ejection head.

9. A nozzle face wiping device that cleans a nozzle face of an ejection head, the nozzle face wiping device comprising:

a wiping web that is contacted to the nozzle face and wipes out the nozzle face;

a wiping web running drive device which runs the wiping web along a longitudinal direction;

a pressure member that presses and contacts the wiping web to the nozzle face;

a biasing device which gives force to press the wiping web to the nozzle face through the pressure member; and a tension giving device which gives tension to the wiping web by making running speed on a downstream side of the wiping web with respect to the pressure member faster than running speed on an upstream side of the wiping web, and moving the pressure member in a direction against biasing force of the biasing device, wherein whether to wipe out the nozzle face is switched by giving the tension.

10. An image recording device comprising:

a transportation portion that transports a recording medium;

an ejection head that ejects an ink drop to the recording medium transported by the transportation portion and forms an image; and a nozzle face wiping device according to claim 9 that cleans a nozzle face of the ejection head.

* * * * *